US007547080B2

(12) United States Patent
Hightower

(10) Patent No.: US 7,547,080 B2
(45) Date of Patent: Jun. 16, 2009

(54) ROLLOUT TRAY MOUNTING SYSTEM FOR CABINET

(75) Inventor: Robert C. Hightower, High Point, NC (US)

(73) Assignee: Tenn-Tex Plastics Inc., Colfax, NC (US)

( * ) Notice: Subject to any disclaimer, the term of this patent is extended or adjusted under 35 U.S.C. 154(b) by 1270 days.

(21) Appl. No.: 10/438,475

(22) Filed: May 15, 2003

(65) Prior Publication Data

US 2003/0218409 A1 Nov. 27, 2003

Related U.S. Application Data

(63) Continuation-in-part of application No. 10/145,305, filed on May 13, 2002, now Pat. No. 6,840,590.

(51) Int. Cl.
*A47B 97/00* (2006.01)

(52) U.S. Cl. ..... 312/249.4

(58) Field of Classification Search ..... 312/334.4, 312/334.7, 348.2, 249.4, 334.1, 249.11, 330.1; 248/250, 235

See application file for complete search history.

(56) References Cited

U.S. PATENT DOCUMENTS

| | | | | | |
|---|---|---|---|---|---|
| 3,119,643 | A | | 1/1964 | Levi et al. | 312/343 |
| 3,846,001 | A | * | 11/1974 | Kaplan et al. | 384/23 |
| 4,154,492 | A | | 5/1979 | Dunning, III | |
| 4,681,381 | A | | 7/1987 | Sevey | |
| 5,039,181 | A | | 8/1991 | Lautenschlager | 312/343 |
| 5,310,255 | A | | 5/1994 | Ranallo | 312/334 |
| 5,370,454 | A | * | 12/1994 | Domenig | 312/348.1 |
| 5,372,417 | A | | 12/1994 | Buie et al. | |
| 5,457,867 | A | | 10/1995 | Maberry et al. | 29/525 |
| 5,597,220 | A | | 1/1997 | Domenig et al. | 312/334.4 |
| 5,746,490 | A | | 5/1998 | Domenig | 312/334.5 |

(Continued)

FOREIGN PATENT DOCUMENTS

EP 0 791 313 A 8/1997

(Continued)

OTHER PUBLICATIONS

Louis and company, Your single source for hardware, laminate, machinery & solid surfacing. "Adjustable Pantry Suspension Systems" (Vogt industries, inc.) p. F12.

(Continued)

*Primary Examiner*—A. Joseph Wujciak, III
(74) *Attorney, Agent, or Firm*—Myers Bigel Sibley & Sajovec

(57) ABSTRACT

A connector for supporting one or more mounting members that may be used in mounting a drawer within a cabinet includes: a vertically elongated base configured to abut an interior face of a wall of the cabinet and vertically elongated first and second mounting panels that are connected to and projecting outwardly from the base. The second mounting panel may be spaced apart from, and substantially parallel to, the first mounting panel, and the first and second mounting panels may extend from a base panel that extends perpendicular to the first and second mounting panels. The connector may also include an end panel that connects the distal end of the first mounting panel to the distal end of the second mounting panel.

39 Claims, 16 Drawing Sheets

U.S. PATENT DOCUMENTS

| | | | | |
|---|---|---|---|---|
| 5,823,648 | A | 10/1998 | Domenig | 312/334.5 |
| 5,833,337 | A | 11/1998 | Kofstad | 312/334.5 |
| 5,890,784 | A * | 4/1999 | Domig | 312/334.4 |
| 5,904,412 | A | 5/1999 | Lammens | 312/334.7 |
| 6,010,200 | A | 1/2000 | Hays | 312/334.7 |
| 6,070,957 | A | 6/2000 | Zachrai | 312/334.4 |
| 6,155,660 | A | 12/2000 | Nicolai | 312/223.1 |
| 6,196,141 | B1 * | 3/2001 | Herron et al. | 108/108 |
| 6,270,281 | B1 | 8/2001 | Ruusuvuori | 403/11 |
| 6,273,534 | B1 | 8/2001 | Bueley et al. | 312/334.8 |
| 6,367,900 | B1 | 4/2002 | Woerner | 312/334.5 |
| 6,374,649 | B1 * | 4/2002 | Holcomb et al. | 70/78 |
| 6,402,276 | B1 | 6/2002 | King | 312/334.7 |
| 6,422,399 | B1 | 7/2002 | Castillo et al. | 211/26 |
| 6,431,668 | B1 * | 8/2002 | Reddicliffe | 312/334.5 |
| 6,494,550 | B1 | 12/2002 | Chen et al. | 312/334.5 |

FOREIGN PATENT DOCUMENTS

| | | |
|---|---|---|
| GB | 1 221 763 | 2/1971 |
| JP | 2001204565 | 5/2001 |

OTHER PUBLICATIONS

Louis and company, Your single source for hardware, laminate, machinery & solid surfacing. "Base Cabinet Pilaster System" (Houck Industries, Inc.) p. F12.

Louis and company, Your single source for hardware, laminate, machinery & solid surfacing. "Adjustable Base Cabinet Suspension Systems" (Vogt Industries, Inc.) p. F12.

Louis and company, Your single source for hardware, laminate, machinery & solid surfacing. "Rod Pilaster & Rail Kit" (Omega Industries, Inc.) p. F13.

Louis and company, Your single source for hardware, laminate, machinery & solid surfacing. "Wire Fence Rail System" Rev-A-Shelf, p. F13.

Louis and company, Your single source for hardware, laminate, machinery & solid surfacing. "Pilaster Mounting Bracket" (GRASS) p. F13.

Partial European Search Report EP 03 01 0602 (2003).

* cited by examiner

ROLLOUT TRAY MOUNTING SYSTEM FOR CABINET

RELATED APPLICATION

This application is a continuation-in-part application of co-assigned U.S. application Ser. No. 10/145,305 to Robert Hightower, filed May 13, 2002 now U.S. Pat. No. 6,840,590, the disclosure of which is hereby incorporated by reference herein in its entirety as if it were set forth fully herein.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate slide members that are fixed to the side walls of the drawer. Each slide member slidably engages a second elongate slide member that is fixed to the walls of the cabinet (often one of the slide members includes a small wheel that facilitates sliding motion). Some of such cabinets include multiple drawers, which can be disposed in vertically stacked fashion, side-by-side fashion, or both. When drawers are located side-by-side, typically slide members are mounted to the rear wall of the cabinet and to an upright member at the front of the cabinet that the slide members of the cabinet can engage.

In some instances, it is desirable that the mounting height of the drawer be adjustable. This is particularly true when the cabinet includes one or more doors that cover the drawers and provide the visible front surface of the cabinet. The adjustability enables the user to select drawer heights that are convenient for the items to be stored. Adjustable height drawers are particularly popular when they take the form of flat trays, which often include a short perimeter rim to keep items from sliding off. Over the life of the cabinet, the user may choose to store different items on the tray, so the ability to adjust the mounting elevation of the tray can enable the cabinet to accommodate these different items.

One system for providing adjustable height drawers and trays includes short (typically about 6 inches in length) vertically disposed mounting members to which slide members are mounted. The vertical mounting members, which are L-shaped in cross-section, are typically mounted to the side walls of the cabinet via screws inserted into a recessed surface of the mounting member. The vertical mounting members include a series of round holes in their front surfaces into which round dowels projecting from the slide members can be inserted. Thus, the mounting height of the drawer is determined by which hole in the mounting members receives the round dowel.

One issue with this system is the attachment of the round dowel to the slide member. Because the dowel is typically relatively small (about 0.320 inch in diameter) and is round, it can be somewhat difficult to attach via screws to the slide member, as the dowel tends to spin undesirably during attachment. Also, the round dowels tend to slide out of the holes in the vertical mounting member during shipping and/or use of the cabinet. Moreover, the screws tend to "back-out" of the holes in the dowels, which can loosen the dowels or even cause them to become disconnected from the slide members.

Further, when the system discussed above is employed with a "face-frame" cabinet (i.e., one which includes a front wall frame attached to the front portions of the side walls of the cabinet), the vertical mounting members are typically mounted in the front corners of the cabinet. However, in many instances glue and/or staples used to attach the front wall frame to the side walls are present in the corners. Consequently, it may be difficult in some instances to position the mounting member flush against the corner. Also, the relatively short length of the mounting members ordinarily requires the installer to position the mounting members precisely so that the holes of facing mounting members are at substantially the same height; otherwise, the tray or drawer may not be level when mounted.

In addition, when used in a "frameless" cabinet (i.e., one in which there is no front frame piece), the mounting members are typically mounted in pre-formed holes in the side wall that are offset slightly from the front edge of the side wall. The hinges for the cabinet door are typically mounted to the inside surfaces of the side walls (often in the pre-formed holes). When the hinges are so mounted, the mounting members are mounted between the hinges and should extend far enough from the side wall into the interior of the cabinet to position the drawer slide member so that the drawer can slide in and out of the cabinet without interference from the hinges.

SUMMARY OF THE INVENTION

Embodiments of the present invention are directed to connectors that may be used to support one or more mounting members that may be used in mounting drawer(s) within a cabinet. These connectors may comprise a vertically elongated base configured to abut an interior face of a wall of the cabinet and vertically elongated first and second mounting panels that are connected to and project outwardly from the base. The first mounting panel may be spaced apart from, and substantially parallel to, the second mounting panel, and the base may be perpendicular to the first and second mounting panels. The connector may also include an end panel that connects the distal end of the first mounting panel to the distal end of the second mounting panel.

In embodiments of the present invention, the base may include a base panel, a vertically elongated first lip and/or a vertically elongated second lip. The base panel and/or first and second lips may include one or more apertures that facilitate mounting the connector to the wall of a cabinet. In embodiments of the invention, the first and second lips may comprise the entirety of the base. The connector may also include one or more reinforcing ribs that extend between the first mounting panel and the second mounting panel, and may further include an alignment slot that may facilitate aligning the connector during installation. In certain embodiments, the connector is a unitary structure formed of a polymeric material.

In further embodiments of the present invention, the connector may comprise an elongate body portion having a base panel and two opposed, substantially parallel mounting panels projecting outwardly from the base panel along the longitudinal axis of the base panel so as to define a channel. These connectors may further include a first lip that extends from a first lateral edge of the base panel and perpendicular to the mounting panels and/or a second lip extending from a second lateral edge of the base panel and perpendicular to the mounting panels. The first and/or second lip may also include one or more apertures. These connectors may also include an end panel that connects the distal ends of the mounting panels.

Pursuant to a further aspect of the present invention, cabinets are provided that are adapted to receive a drawer where the cabinet comprises an enclosure that includes an upright rear wall, opposing upright side walls, and an upright front wall that has an access opening and a central member that extends generally vertically across the access opening. These cabinets may further include a pair of front outer mounting members, a pair of rear outer mounting members, a pair of front inner mounting members and a pair of rear inner mounting members. The mounting members may be used to support a pair of outer slide members and a pair of inner slide members which, in turn, may be used to support a pair of drawers or trays. In these cabinets, one or more of the mounting members may be mounted on the side mounting panels of connectors made according to embodiments of the present invention.

Pursuant to another aspect of the present invention, assemblies or kits are provided of hardware that may be used to mount a drawer within a cabinet. These assemblies include at least an elongate slide member that is configured to slidably mate with an engagement member of a sliding tray, a pair of mounting members and a connector according to one of the embodiments of the present invention.

An additional aspect of the present invention is directed to methods of installing a cabinet drawer mounting member along with an associated connector within a face-frame cabinet in a manner that allows the drawer mounting hardware to be easily and conveniently installed so as to properly align the drawer within the cabinet. Pursuant to these methods the connector is attached to a wall of the cabinet so that the bottom surface of the connector contacts the floor of the cabinet, and the mounting member is attached to the connector such that the bottom of the mounting member is positioned at a predetermined height above the bottom of the mounting member. A slide member is attached to the mounting member and the installation may be completed by slidably installing the drawer on the slide member.

DETAILED DESCRIPTION OF THE INVENTION

Figure 1:
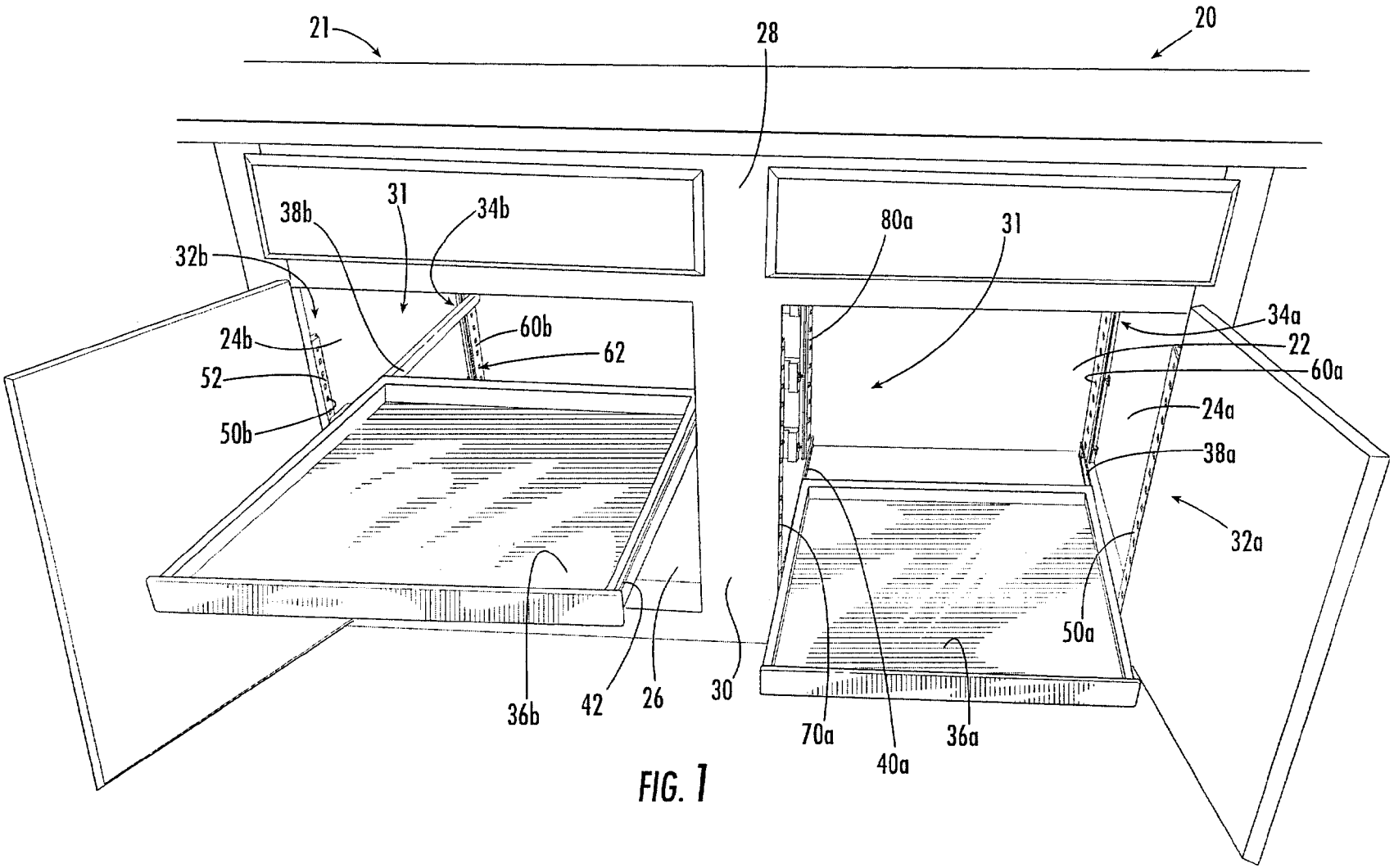
FIG. 1 is front perspective view of a cabinet of the present invention.
Figure 2:
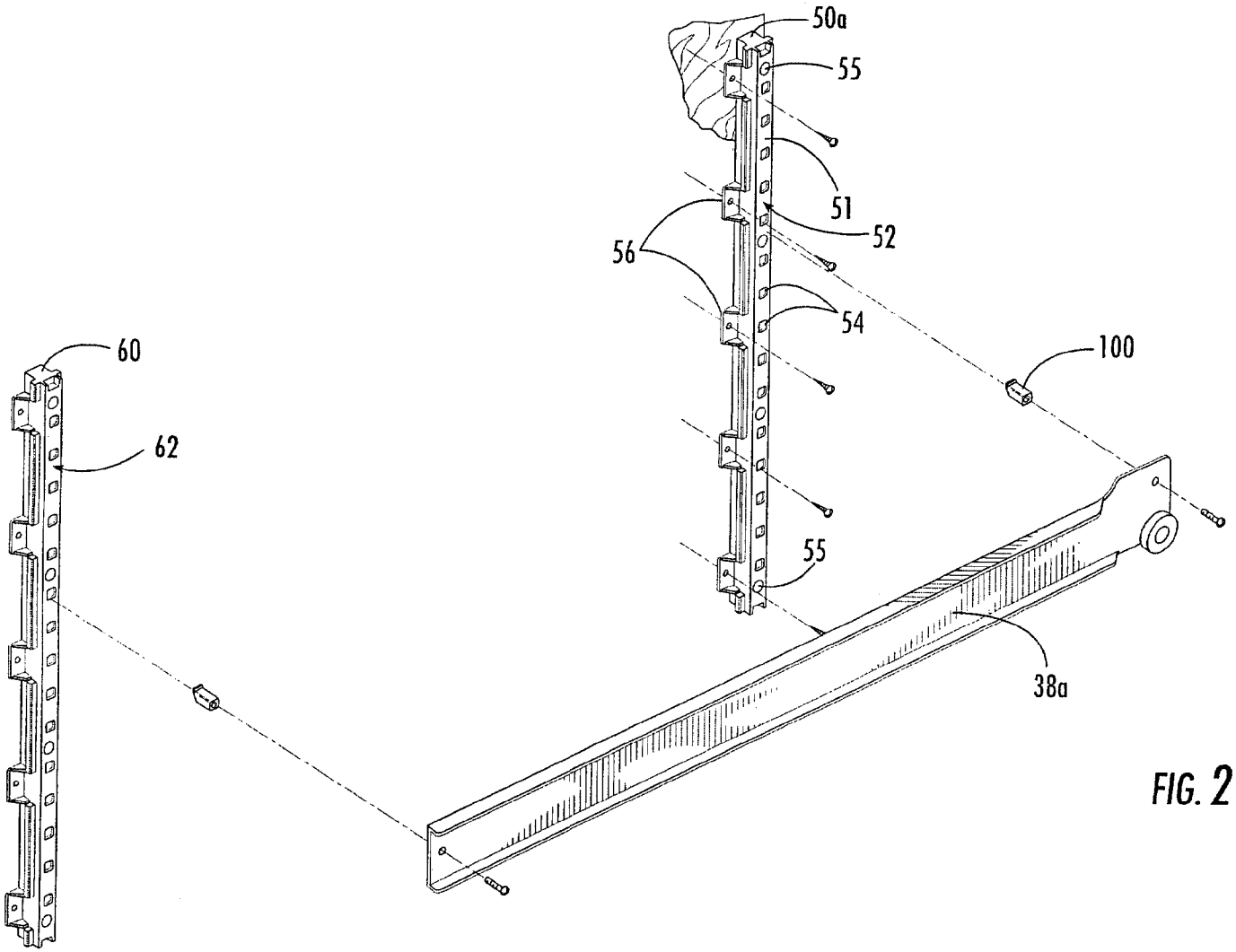
FIG. 2 is an exploded perspective view of front and rear mounting members, a slide member and two mounting dowels of the cabinet of FIG. 1.
Figure 3:
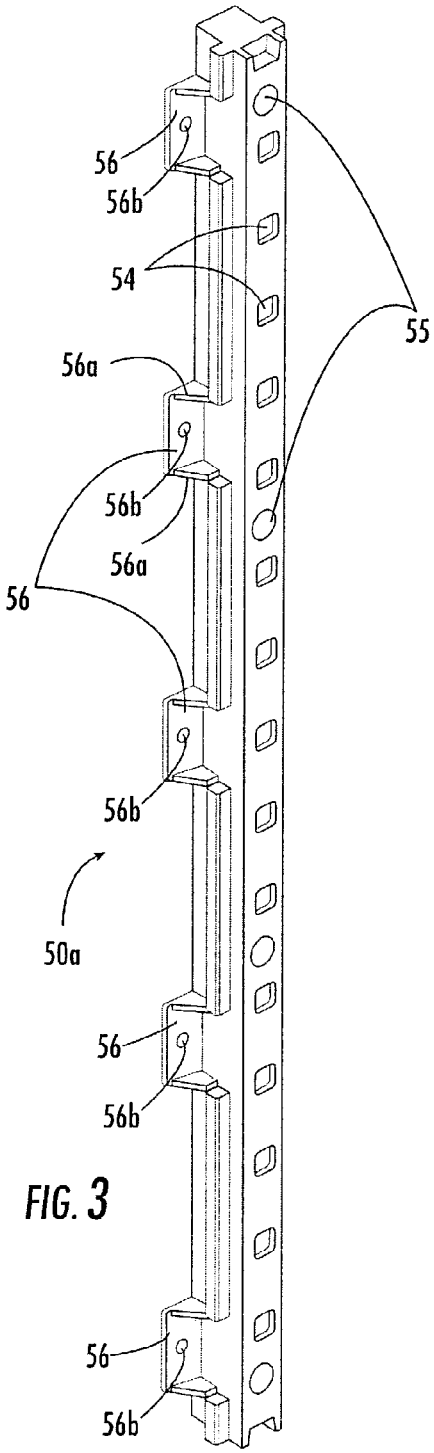
FIG. 3 is a perspective view of a mounting member of the cabinet of FIG. 1.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the figures, a face-frame cabinet, designated broadly at 20, is illustrated in FIG. 1. The cabinet 20 includes an enclosure 21 having a rear wall 22, side walls 24*a*, 24*b* mounted perpendicular thereto, a floor 26 generally that is horizontally disposed, and a front wall 28 mounted generally parallel to the rear wall 22. The front wall 28 includes a vertical center member 30 that defines two access openings 31 on either side. Typically the enclosure 21 is formed of wood, but other materials known to be suitable for cabinets may also be employed.

Those skilled in this art will recognize that the configuration of the enclosure 21 can vary and still be encompassed by the present invention. For example, the enclosure 21 may lack a center member 30, with the result that the cabinet 20 has only one access opening, or it may have more than one vertical member, with the result that the cabinet 20 has more than two access openings.

Figure 9:
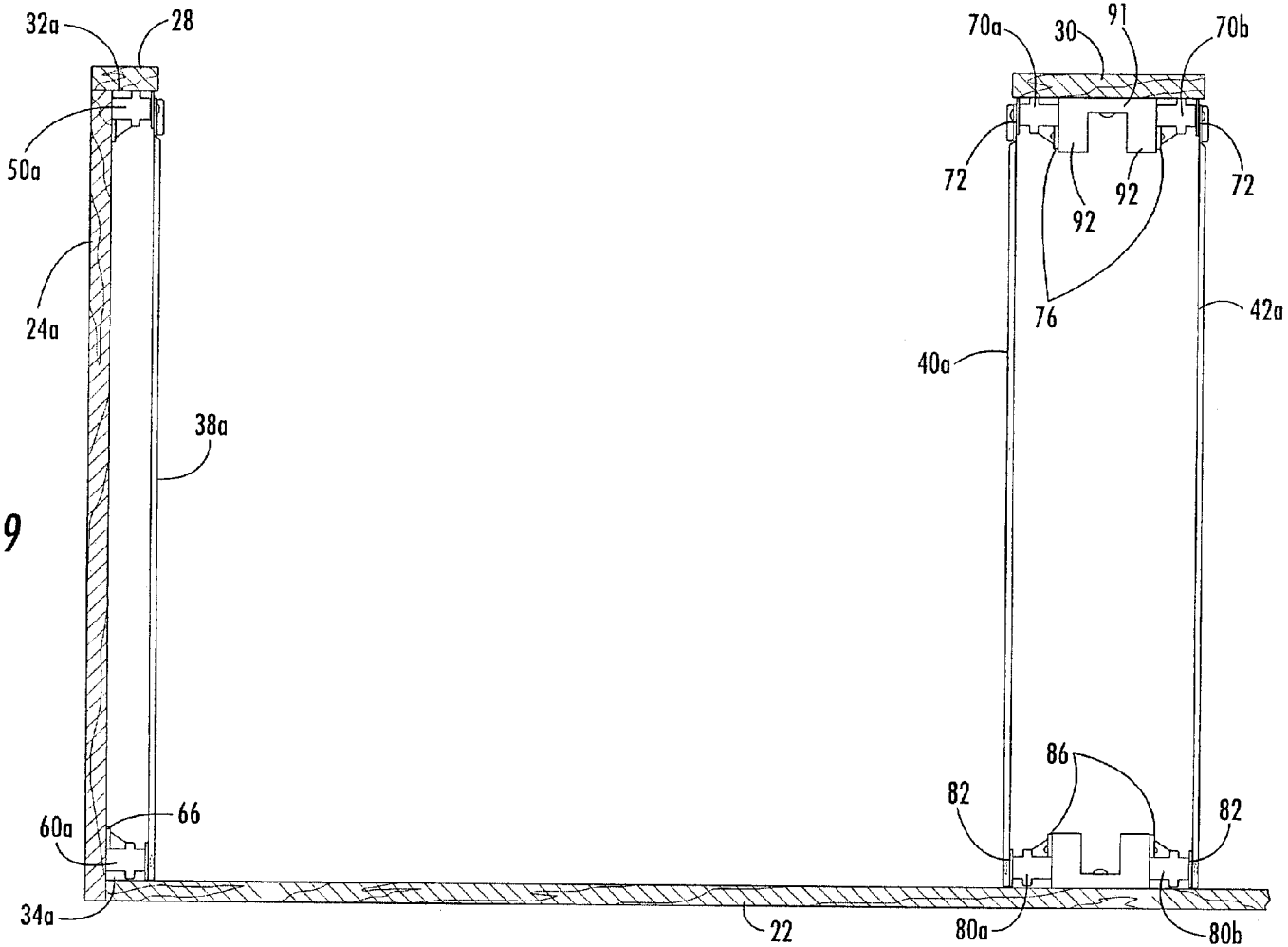
FIG. 9 is a top section view of the cabinet of FIG. 1 showing the mounting configuration of the inner slide members.

The respective intersections between the rear wall 22 and the side wall 24*a*, 24*b* form rear corners (one is shown at 34*a* in FIG. 9). Similarly, the respective joints between the front wall 28 and the side walls 24*a*, 24*b* form front corners (one is shown at 32*a* in FIG. 9).

Referring again to FIG. 1, two trays 36*a*, 36*b* are slidably mounted within the enclosure 21. Each tray 36*a*, 36*b* is attached to elongate engagement members 42 (one of which is shown in FIG. 1) that extend generally horizontally along the side edges of the trays 36*a*, 36*b*. Those skilled in this art will recognize that the trays 36*a*, 36*b* may be replaced by drawers, and that different numbers of trays and/or drawers that that described herein may be employed with the present invention.

Referring again to FIG. 1 and also to FIG. 9, within the enclosure 21, slide members 38*a*, 38*b* are horizontally disposed between respective front corners 32*a*, 32*b* and respective rear corners 34*a*, 34*b*. In addition, a pair of inner slide members 40*a*, 40*b* are mounted between the center member 30 and a central portion of the rear wall 22. The slide members 38*a*, 38*b* and the inner slide members 40*a*, 40*b* engage the engagement members 42 of the trays 36*a*, 36*b* and enable the trays 36*a*, 36*b* to slide relative to the remainder of the cabinet 20. Any configuration of slide members and engagement members that enable sliding movement of the trays 36*a*, 36*b* and the enclosure 21 may be employed with the present invention.

Referring to FIGS. 1, 2, 9 and 10, the slide members 38*a*, 38*b* and the inner slide members 40*a*, 40*b* are mounted to the cabinet 20 via vertically disposed mounting members. Front mounting members 50*a*, 50*b* are mounted in respective front corners 32*a*. Rear mounting members 60*a*, 60*b* are mounted in respective rear corners 34*a*. Front inner mounting members 70*a*, 70*b* are mounted to the rear surface of the center member 30. Rear inner mounting members 80*a*, 80*b* are mounted to a central portion of the rear wall 22. In the illustrated embodiment, the structure of each of the front mounting members 50*a*, 50*b*, the rear mounting members 60*a*, 60*b*, the front inner mounting members 70*a*, 70*b*, and the rear inner mounting members 80*a*, 80*b* is substantially identical, with only the manner by which these components are mounted and their orientation within the cabinet 20 differing. As such, only the front mounting member 50*a* will be described in detail herein, with the understanding that this discussion is equally applicable to the other mounting members. Differences in mounting location and orientation for the other mounting members will be pointed out below.

Turning now to FIGS. 2-4 and 5B, the front mounting member 50*a* has a body 51 that is elongate and has a generally U-shaped cross-section. The base of the "U" provides a mounting surface 52 that includes a plurality of apertures 54 (illustrated herein as being generally rectangular) substantially equally spaced along the longitudinal axis A1 of the body 51 (the spacing is typically between about 0.75 and 2 inches). Also, four countersunk apertures 55 are present in the mounting surface 52. Opposed side walls 53*a*, 53*b* extend generally perpendicularly from the mounting surface 52 and parallel to each other to form the legs of the "U" of the body 51.

Figure 4:
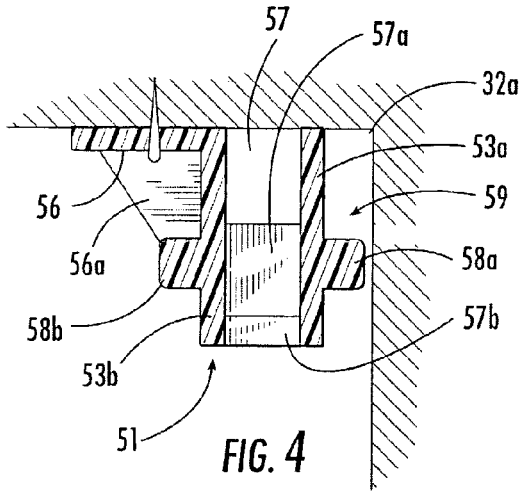
FIG. 4 is a top section view of the mounting member of FIG. 3 mounted in a front corner of the cabinet of FIG. 1.
Figure 5A:
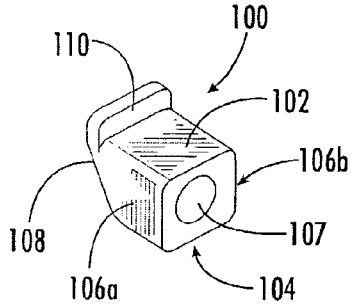
FIG. 5A is a perspective view of a mounting dowel of the cabinet of FIG. 1.
Figure 5B:
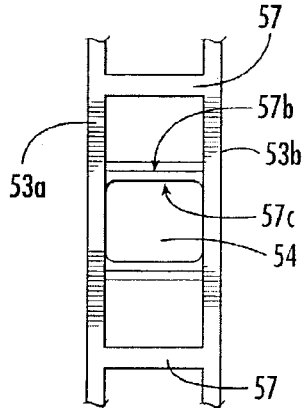
FIG. 5B is an enlarged rear partial view of the mounting member of FIG. 3.
Figure 6:
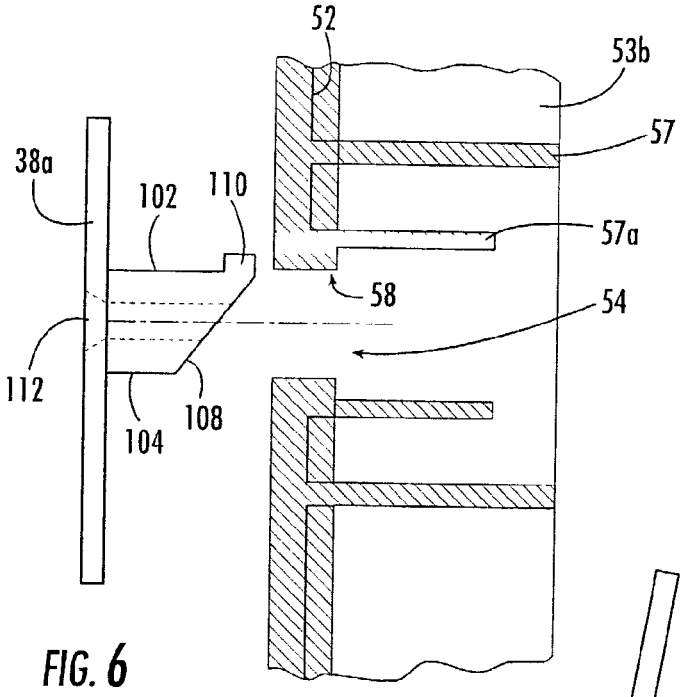
FIG. 6 is an enlarged partial front view of the slide member and mounting dowel of the cabinet of FIG. 1 prior to insertion into a mounting member.
Figure 7:
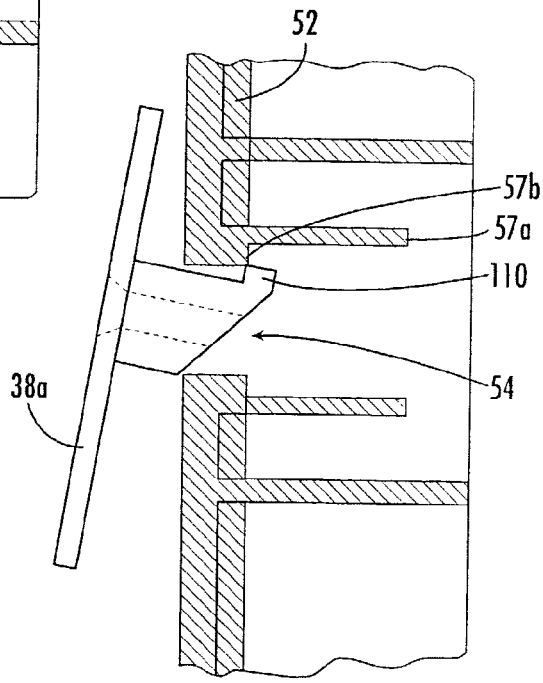
FIG. 7 is an enlarged partial front section view of the slide member, mounting dowel and mounting member of FIG. 6 with the dowel partially inserted in the mounting member.
Figure 8:
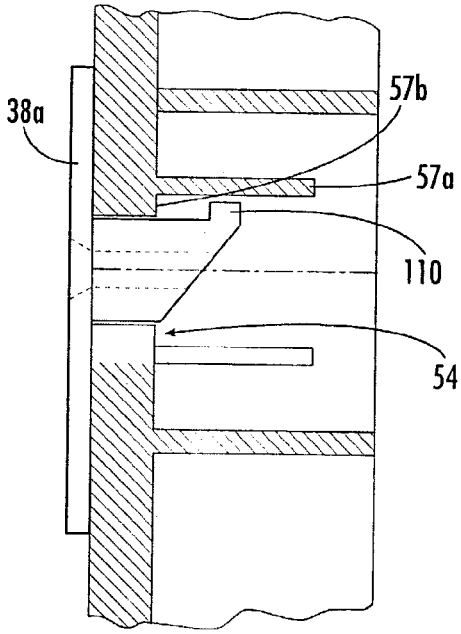
FIG. 8 is an enlarged partial front section view of the slide member, mounting dowel and mounting member of FIG. 6 with the dowel fully inserted in the mounting member.

Referring now to FIGS. 4 and 5B, the front mounting member 50*a* also includes a plurality of horizontally disposed ribs attached to and extending away from the mounting surface 52. Support ribs 57 are positioned between pairs of adjacent apertures 54 and extend the full width of the side walls 53*a*, 53*b*. Engagement ribs 57*a* are positioned directly above and below the apertures 54 and extend away from the mounting surface 52 for approximately two-thirds of the width of the side walls 53*a*, 53*b*. Illustratively and preferably, each engagement rib 57*a* has a stepped surface 57*b* that defines the upper or lower perimeter portion (depending on its location) of the adjacent aperture 54.

A number of mounting tabs 56 that include apertures 56*b* extend from the side wall 53*a*. The mounting tabs 56 are reinforced by gussets 56*a* that extend between the mounting tabs 56 and the side wall 53*a*. Also, spacing ears 58*a*, 58*b* located on each side wall 53*a*, 53*b* project outwardly a short distance in a direction parallel to the mounting surface 52*a*. As a result, on the side of the front mounting member 50*a* opposite the mounting tabs 56 (i.e., on side wall 53*b*), a cut-away region 59 is formed.

Figure 20:
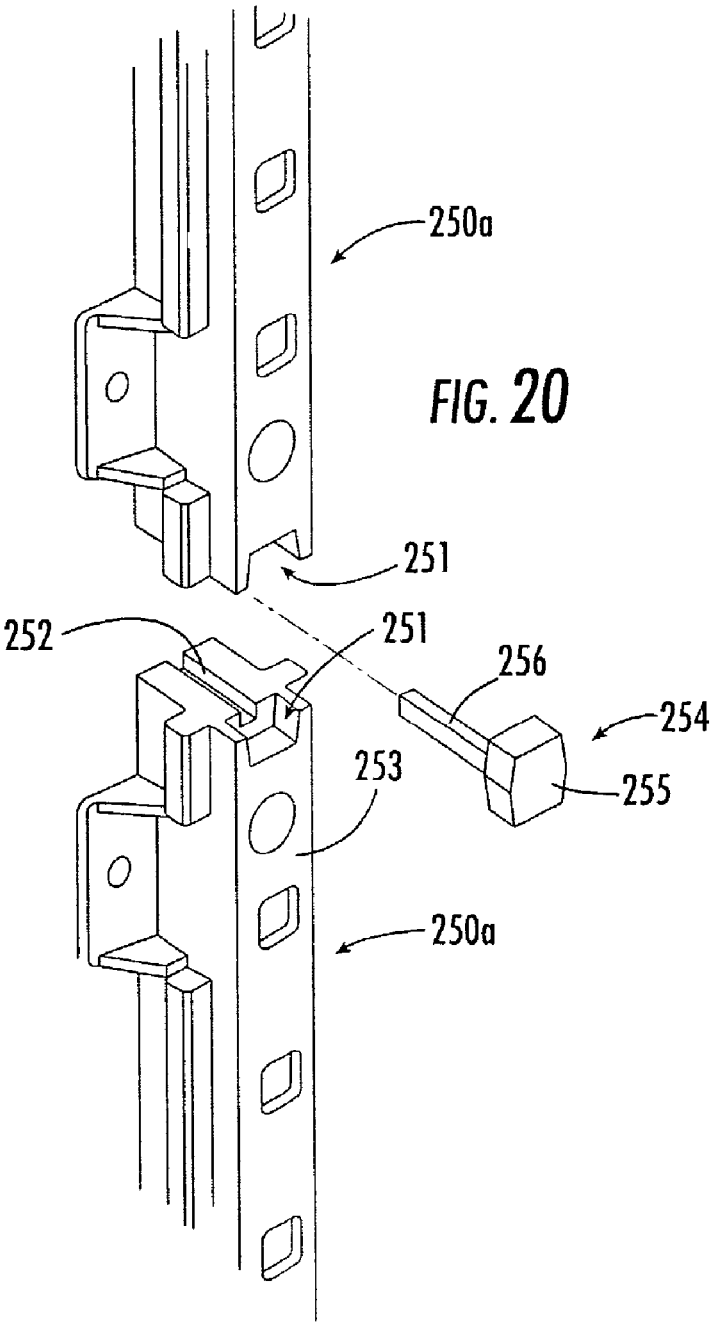
FIG. 20 is an enlarged partial perspective view of a pair of mounting members being interconnected according to embodiments of the present invention.

Typically the mounting member 50*a* is formed of a polymeric material (such as ABS), but it can be formed of any material known to be suitable for forming into the desired shape. The mounting member 50*a* may be of any length, but is typically at least 12 inches in length, and in some embodiments at least 24 inches in length. Notably, the mounting member 50*a* may include structures at either end that enable two or more mounting members 50*a* to be stacked vertically. For example, an additional variation of a mounting member (designated at 250*a*) illustrated in FIG. 20 include a recess 251 in the front mounting surface 253 at each end, with a further slot 252 extending longitudinally within the recess 251. An alignment pin 254 with a head 255 and a shaft 256 is employed to align the mounting members 250*a*. The head 255 is shaped to conform to a second recess formed by the combination of the recesses 251, and the shaft 256 is shaped to fit within the combined slots 252. Thus, in the event a cabinet requires that more that one mounting member 250*a* be used at each mounting location, multiple mounting members 250*a* can be stacked upon one another and aligned longitudinally with the pin 254.

Referring now to FIG. 4, the front mounting member 50*a* is mounted in the front corner 32*a* of the enclosure 21. The front mounting member 50*a* is mounted such that the mounting surface 52 faces the opposite side wall 24*b*, the mounting tabs 56 extend toward the rear wall 22, and the cutaway area 59 encloses the front corner 32*a*. The front mounting member 50*a* is attached to the side wall 24*a* via screws, staples, or other appropriate fasteners (screws being preferred) that are inserted through the mounting tabs 56. Alternatively, the mounting member may 50*a* be mounted to the cabinet side wall 24*a* via screws inserted through the countersunk apertures 55. Notably, the presence of the cutaway area 59 enables the front mounting member 50*a* to be mounted in the front corner 32*a* flush with the rear surface of the front wall 28 and the inner surface of the side wall 24*a* without interference from glue, nails, staples, and the like that may be present in the front corner 32*a*.

Referring again to FIGS. 1 and 9, the mounting orientation of the remaining mounting numbers is illustrated. The front mounting member 50*b* is mounted in the front corner 32*b* with its mounting surface 50 facing the side wall 24*a* and its mounting tabs 56 extending toward the rear wall 22. The rear mounting member 60*a* is mounted in the rear corner 34*a* with its mounting surface 62 facing the side wall 24*b* and its mounting tabs 66 extending toward the front wall 28. The rear mounting member 60*b* is mounted in the rear corner 34*b* with its mounting surface 62 facing the side wall 24*a* and its mounting tabs 66 also extending toward the front wall 28.

Figure 10:
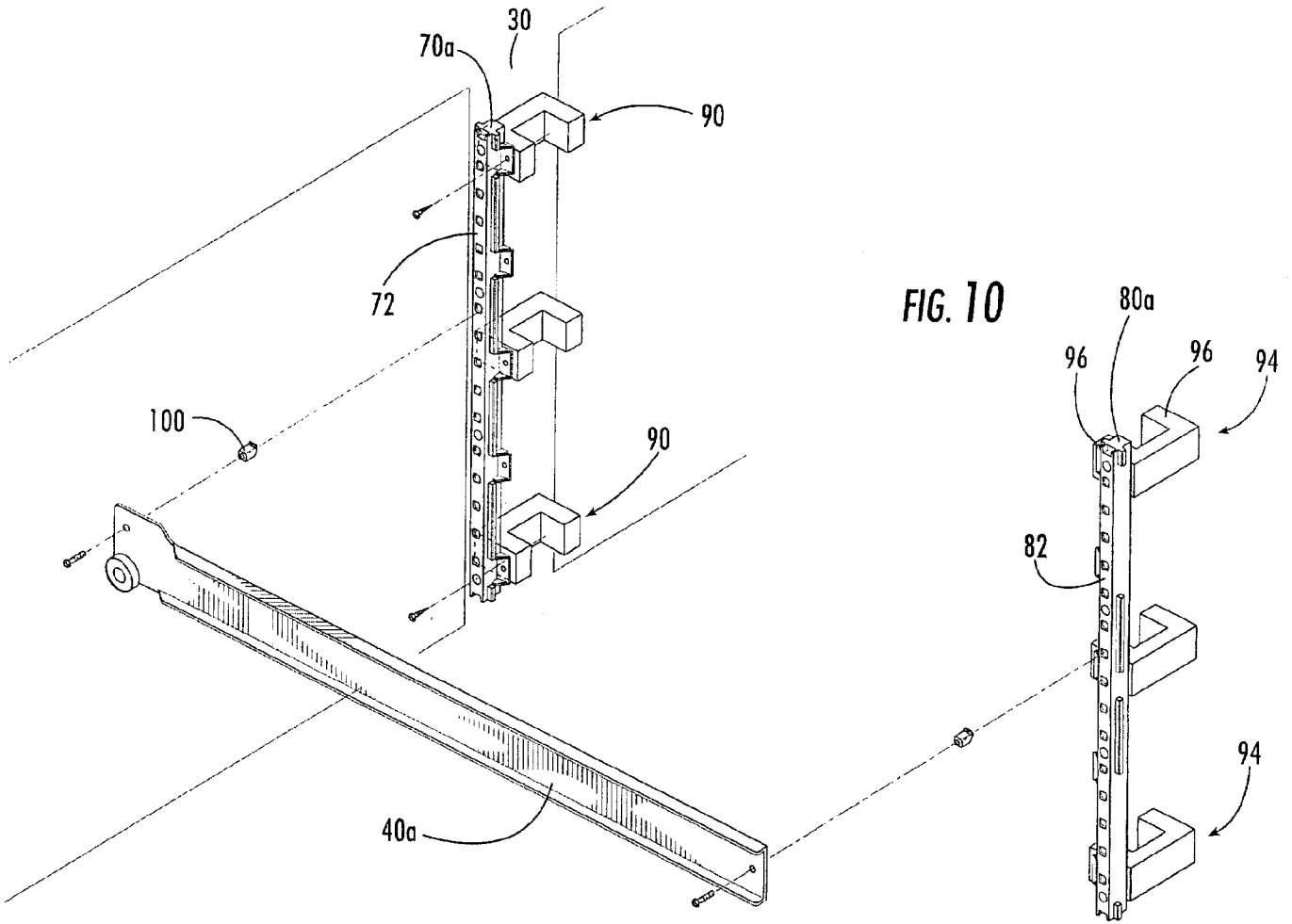
FIG. 10 is a rear exploded perspective view showing the mounting of an inner slide member into two inner mounting members in the cabinet of FIG. 1.

Referring now to FIGS. 9 and 10, the front inner mounting members 70*a*, 70*b* and the rear inner mounting members 80*a*, 80*b* are mounted to, respectively, the center member 30 of the front wall 28 and a central portion of the rear wall 22 through three front connectors 90 and three rear connectors 94. Each front connector 90 includes a body 91 and a pair of mounting flanges 92. The body 91 is mounted flush against the rear surface of the center member 30. Similarly, the three rear connectors 94 are mounted to a central portion of the rear wall 22 with their mounting flanges 96 extending forwardly.

The front inner mounting members 70*a*, 70*b* are mounted to the mounting flanges 92 of the front connector 90. More specifically, the mounting tabs 76 of the front inner mounting members 70*a*, 70*b* overlie the mounting flanges 92 and are attached thereto via screws, staples or the like. The front inner mounting member number 70*a* is mounted such that its mounting surface 72 faces the side wall 24*a* and its mounting tabs 76 face rearwardly. The front inner mounting member 70*b* is mounted such that its mounting surface 72 faces the side wall 24*b* and its mounting tabs 76 face rearwardly. The rear inner mounting member 80*a* is mounted to the rear connector 94 such that its mounting surface 82 faces the side wall 24*a* and its mounting tabs 86 face forwardly. Similarly, the rear inner mounting member 80*b* is mounted to the rear connector 94 such that its mounting surface 82 faces the side wall 24*b* and its mounting tabs 86 face forwardly.

Those skilled in this art will recognize that other configurations for the mounting members described above may be suitable for use with the present invention. For example, mounting members having more or fewer apertures may be used. Also, the mounting members need not be identical to each other, although utilizing identical mounting members (such as those illustrated herein) may be preferred for simplicity and cost of manufacture, packaging and assembly. Further, if inner front and rear mounting members are included, they may be attached to a vertical member through structures other than the connectors described herein. Moreover, although the inclusion of a cutaway portion 59 is preferred, it may be omitted in some embodiments.

Turning now to FIGS. 5A and 6-8, the mounting dowel 100 illustrated therein has a body 101 of generally rectangular cross-section defined by a top surface 102, a bottom surface 104 and opposing side surfaces 106*a*, 106*b*. An aperture 107 extends through the body 101 for receipt of a screw 112. At one end, the mounting dowel 100 has a tapered portion 108 that terminates in a hook 110 that extends upwardly from the tapered portion 108. The dowel 100 is preferably formed of a metallic material, such as zinc, and has a length of between about 0.250 and 1.50 inch.

Those skilled in this art will recognize that other configurations for the dowel 100 may also be suitable for use with the present invention. For example, the body 101 may have a square cross-section (as used herein, the term "rectangular" in describing cross-sections is intended to encompass square cross-sections as well as non-square rectangular cross-sections), or any number of other non-circular cross-sections (such as triangular, pentagonal, trapezoidal, oblong, or the like). Of course, the shape of the apertures of the mounting member 50*a* should substantially match that of the cross-section of the dowel. Also, some embodiments of the present invention may lack the tapered portion 108 or the hook portion 110. In addition, a dowel of circular cross-section may be used, but should have a hook portion. Further, the hook portion may take different configurations, but should project away from the body in a direction that is generally perpendicular to the longitudinal axis of the body.

To assemble the cabinet 20, first the walls 22, 24*a*, 24*b*, 28 and floor 26 of the enclosure 21 are attached. The front and rear mounting members 50*a*, 50*b*, 60*a*, 60*b* are then inserted into their respective front and rear corners 32*a*, 32*b*, 34*a*, 34*b* and attached to the side walls 24*a*, 24*b* with screws, staples, or like fasteners (preferably screws) inserted through the mounting tabs 56. The front and rear connectors 90, 94 are then attached to, respectively, the rear surface of the center member 30 and the central portion of the rear wall 22. The front and rear inner mounting members 70*a*, 70*b*, 80*a*, 80*b* are then mounted to the flanges 92, 96 of the front and rear connectors 90, 94. The universality of the mounting members can facilitate these steps.

The mounting dowels 100 are then attached to the slide members 38*a*, 38*b* and to the inner slide members 40*a*, 40*b* with screws inserted through the apertures 107 in the dowels 100. The square or rectangular cross-section of the dowels 100 enables the assembler to more easily grasp the dowels 100 as the screws are being inserted. The slide members 38*a*, 38*b* can then be mounted on the mounting members 50*a*, 50*b*, 60*a*, 60*b* by inserting the dowels 100 into a selected aperture 54 in the mounting surface 52 of each mounting member (see FIGS. 6-8). Alternatively, the dowel 100 can be positioned in the desired aperture 54 prior to its attachment to the slide member 38*a*, 38*b*, with the aperture 54 serving to grasp the dowel 100 during the insertion of the screw into aperture 107.

Once the dowel 100 is in place within an aperture 54, the hook portion 110 extends upwardly beyond the elevation of the stepped surface 57*b* of the engagement rib 57*a* and contacts the remainder of the engagement rib 57*a*. The presence of the hook portion 110 and the stepped surface 57*b* assist in maintaining the slide members 38*a*, 38*b* in place, as movement of the dowel 100 out of the aperture 54 is prevented by the stepped surface 57*b*.

After the slide members 38*a*, 38*b* are mounted on the mounting members 50*a*, 50*b*, 60*a*, 60*b*, the inner slide members 40*a*, 40*b* can then be similarly mounted in selected apertures in the front and rear inner mounting members 70*a*, 70*b*, 80*a*, 80*b*. The trays 36*a*, 36*b* can then be mounted in the enclosure 21 by engaging the engagement members 42 with the slide members 38*a*, 38*b* and the inner slide members 40*a*, 40*b* to produce the cabinet 20 of FIG. 1.

Figure 11:
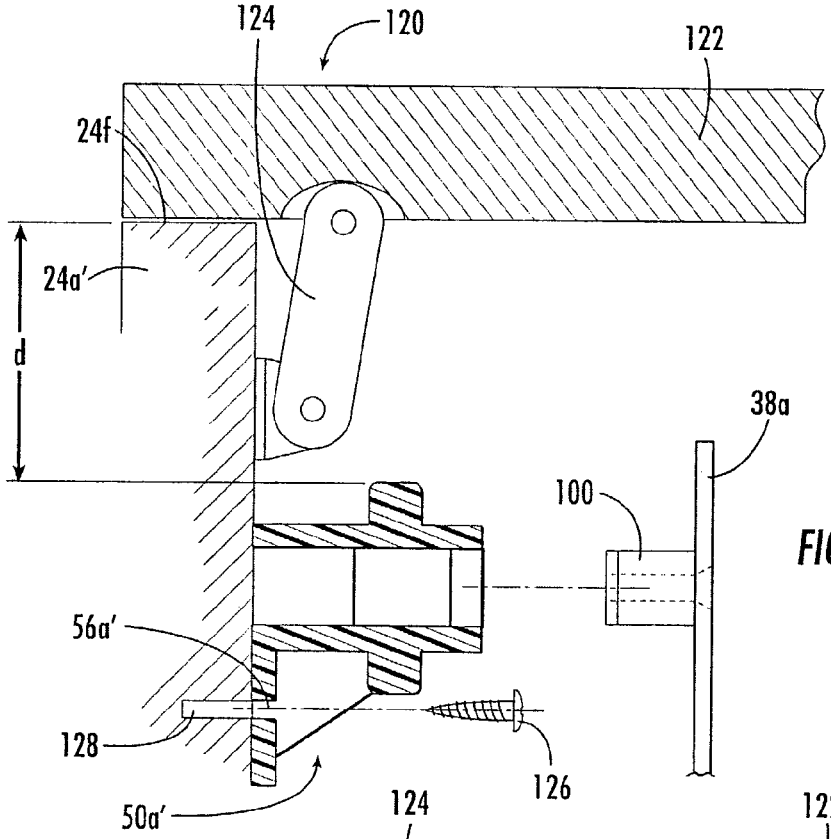
FIG. 11 is a top, exploded section view of a "frameless" cabinet according to the present invention illustrating the position of a mounting member and slide member relative to the front door hinge, with the mounting member being mounted in the cabinet side wall via a screw inserted into a mounting tab.
Figure 12:
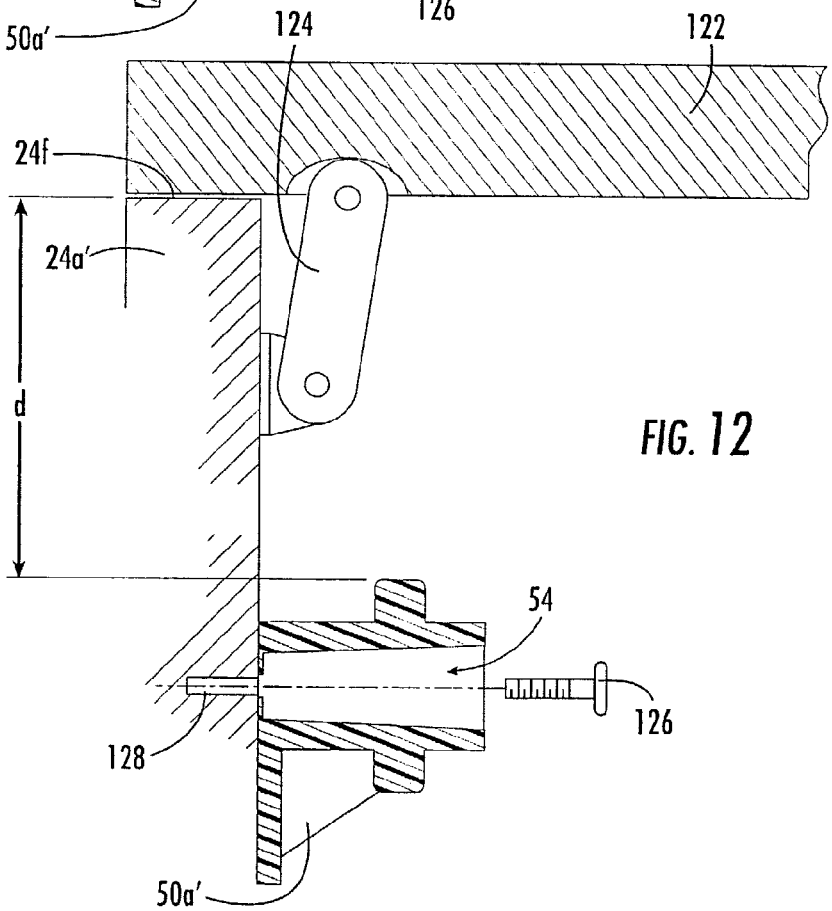
FIG. 12 is a top, exploded section view of the frameless cabinet of FIG. 11 illustrating the mounting of the mounting member to a side wall of the cabinet via insertion of a screw through apertures in the mounting member.

Another embodiment of the present invention is illustrated in FIGS. 11-12, wherein a portion of a frameless cabinet, designated broadly at 120, is shown. The cabinet includes a floor, a rear wall (both of which are absent from FIGS. 11 and 12) and opposed side walls (one of which, designated at 24*a*', is shown in FIGS. 11 and 12). Rather than having a front wall like the cabinet embodiment illustrated in FIGS. 1-10, the cabinet 120 lacks a front wall (hence, the term "frameless" cabinet), and instead includes a door 122 attached to the side wall 24*a*' through a hinge 124. Because of the presence of the hinge 124, a mounting member 50' cannot be positioned in the forwardmost portion of the cabinet 120, but instead is positioned a distance d away from the front edge 24*f* of the side wall 24*a*'. As with the mounting member 50*a* described above, the mounting member 50*a*' may be attached to the side wall 24*a*' via staples, but many frameless cabinets include predrilled holes (such as that shown at 128, which are often included in such cabinets for the mounting of stationary shelves) in which one or more screws 126 may be inserted. The screws 126 may be inserted through the apertures 56*a*'

(see FIG. 11) or through the countersunk apertures 55' (see FIG. 12) and into the predrilled holes 128. Thus, the same mounting member configuration can be employed for either face-frame or frameless cabinets, and can take advantage of the pre-drilled holes often present in frameless cabinets.

Figure 13:
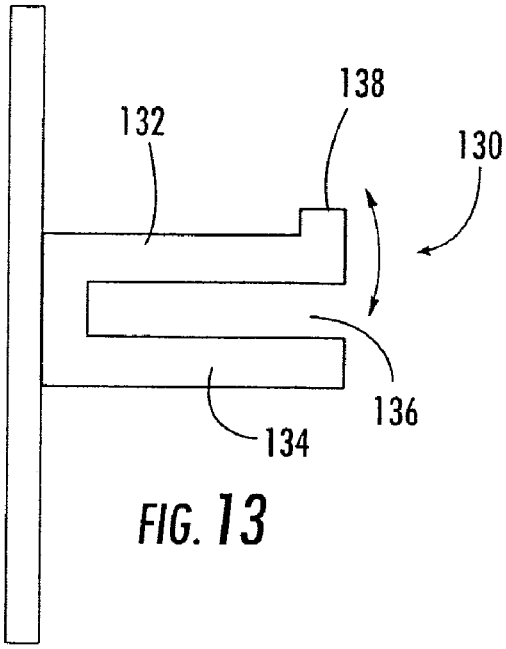
FIG. 13 is a front view of an alternative mounting dowel of the present invention.

Referring now to FIG. 13, another embodiment of a mounting dowel, designated at 130, is illustrated. The mounting dowel 130 includes an upper finger 132 upon which a hook portion 138 is located, and further includes a lower finger 134. The upper and lower fingers 132, 134 define an open slot 136. Like the dowel 100, the dowel 100 has a generally rectangular cross-section. The slotted configuration enables the upper finger 132 to deflect toward and away from the lower finger 134. As such, when the mounting dowel 130 is inserted into an aperture 54 of a mounting member 50, the upper finger 132 can deflect toward the lower finger 134 to facilitate entry of the dowel 130 into the aperture 54. Once the hook portion 138 has advanced sufficiently to clear the stepped surface 57*b*, the upper finger 132 is free to recover toward its original configuration (i.e. to deflect away from the lower finger 134). A dowel 130 having this configuration may facilitate insertion by eliminating or reducing the degree of tilt necessary for insertion (compare, for example, FIG. 7) and improve retention of the dowel 130 within the aperture 54.

Figure 14:
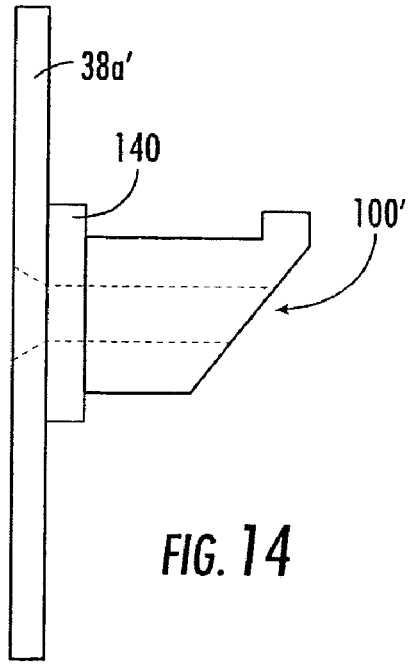
FIG. 14 is a front view of an alternative mounting dowel and slide member of the present invention with a spacer for varying the distance between the dowel hook and the slide member.

Referring now to FIG. 14, another embodiment of a mounting dowel and slide member, designated broadly at 100' and 38*a*', respectively, is illustrated therein. The mounting dowel 100' and the slide member 38*a*' are each of the same configuration as those illustrated in FIGS. 1-10; however, the mounting dowel 100' is separated from the slide member 38*a*' by a spacer 140. The spacer 140 serves to locate the slide member 38*a*' farther from the side wall 24*a* than would be the case absent the spacer 140. This additional distance may be necessary and/or desirable if the front wall of the cabinet extends so far inwardly that the mounting of the slide member illustrated in FIGS. 1-10 positions the tray such that the front wall would block the tray from sliding forwardly beyond the front wall, or if the hinge of a frameless or face frame cabinet is positioned farther inwardly than would allow for unimpeded sliding of the tray. Typically, the spacer 140 is between about 0.090 and 0.250 inch in thickness.

Figure 21:
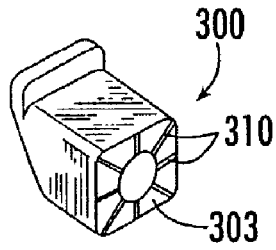
FIG. 21 is a perspective view of a mounting dowel according to embodiments of the present invention.

Another embodiment of a mounting dowel, designated broadly at 300, is illustrated in FIG. 21. The mounting dowel 300 includes raised ridges 310 in the surface 303 that abuts a slide member. The ridges 310 extend radially and protrude from the surface 303 between about 0.005 and 0.020 inches. When the dowel 300 is mounted to the slide member via a screw or other fastener, the ridges 303 grip the surface of the slide member to prevent unwanted twisting or spinning of the dowel 300. Other textured gripping structures, such as knurls, a roughened surface, or the like, may also be used with this embodiment of the invention.

Figure 15:
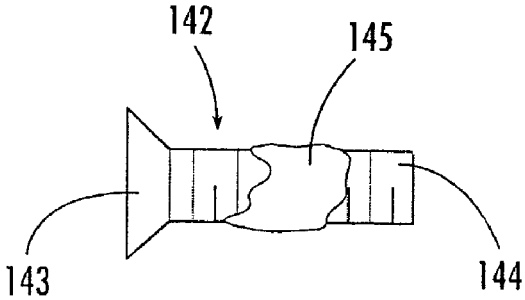
FIG. 15 is a top view of a threaded fastener of the present invention.
Figure 16:
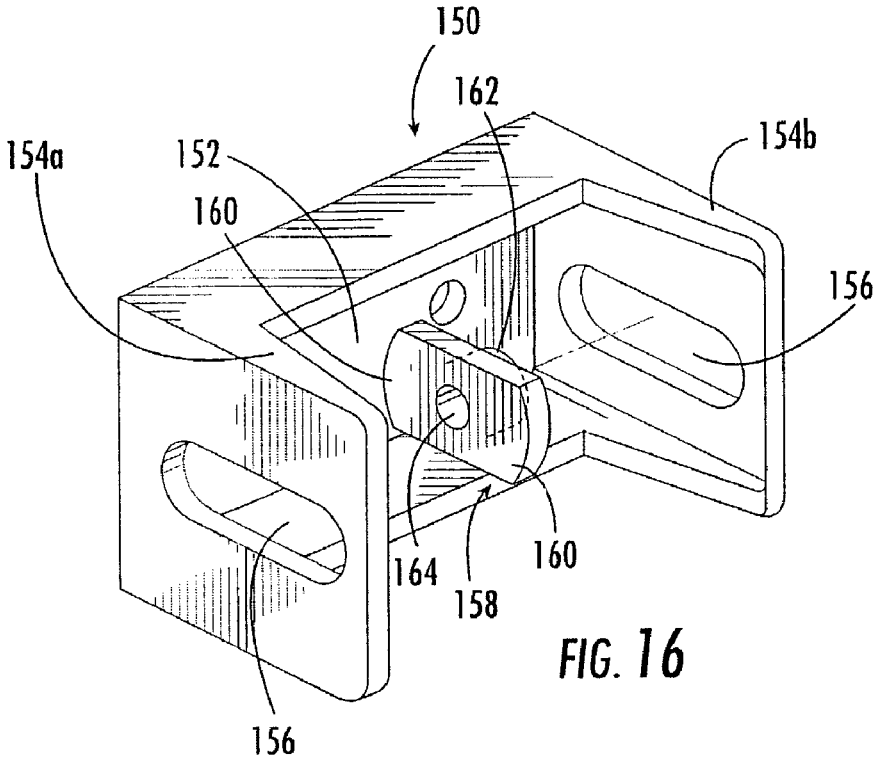
FIG. 16 is an enlarged perspective view of an alternative mounting connector of the present invention.
Figure 17:
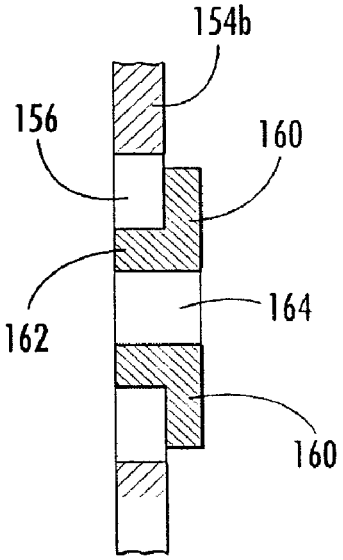
FIG. 17 is a top section view of the connector of FIG. 16.
Figure 18:
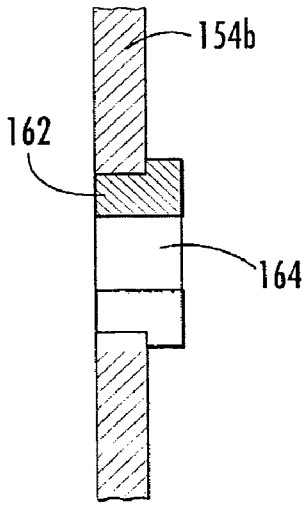
FIG. 18 is a front section view of the connector of FIG. 16.
Figure 19:
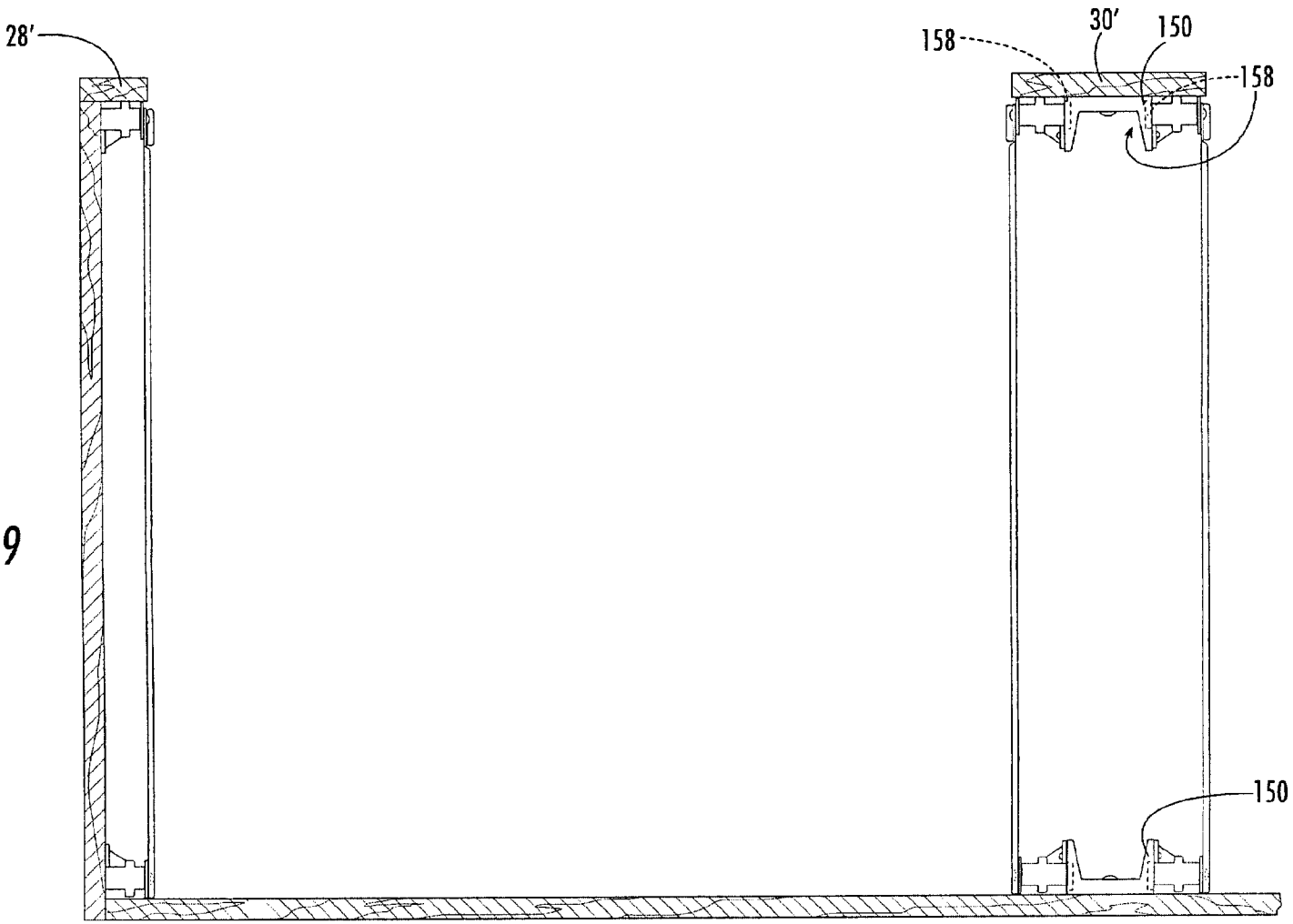
FIG. 19 is a top section view of a cabinet in which the connector of FIG. 16 is mounted.

Referring now to FIG. 15, a screw, designated broadly at 142, is illustrated therein. The screw 142 includes a head 143 and threaded shank 144 of conventional configuration. However, a patch 145 of friction-imparting coating is located on a portion of the shank 144. It has been noted that, in some instances, the screw 112 employed to attach the mounting dowel 100 to the slide member 38*a* has a tendency to "spin out" from the aperture 107 as the tray 36*a* is used, thereby loosening the connection between the mounting dowel 100 and the slide member 38*a*. The inclusion of the friction-imparting patch 145 can reduce or eliminate this tendency. An exemplary material for the patch is nylon. Application of the patch can be any method known to those skilled in this art for the application of the material employed, including spraying, roller or brush application, insert molding, or the like.

Referring now to FIGS. 16-19, another embodiment of a connector for mounting members, designated broadly at 150, is illustrated therein. The connector 150 is generally U-shaped like the connectors 90, 94 and includes a base 152 that abuts a center member 30' of a front wall 28', and further includes a pair of side walls 154*a*, 154*b*. Each side wall includes an oblong aperture 156. An oblong nut 158 has a pair of wings 160 and a central boss 162. The boss 162 has a diameter that is slightly less than the height of the oblong aperture 156. An aperture 164 passes through the boss 162 and receives a screw (not shown) that mounts the front and rear inner mounting members 70*a*', 70*b*', 80*a*', 80*b*'. The oblong shape of the aperture 156 allows the nut 158, and therefore the mounting members 70*a*', 70*b*', 80*a*', 80*b*' to be adjusted forwardly or rearwardly as desired for mounting of the slide members.

The embodiments described above can provide numerous benefits. The rectangular cross-sectional shape of the dowels 100 and 130 can facilitate attachment to the slide members 38*a*, 38*b* and can help to stabilize the mounting of the slide members. The presence of the hook portion 110 assists in maintaining the slide members in place, in particular as the hook portion interacts with the engagement ribs 57*a* and their stepped surfaces 57*b*. The configuration of the mounting members enables a single component to be manufactured rather than requiring "left-hand" and "right-handed" pieces and "front" and "back" pieces, and the mounting members can be of a length to satisfy the needs of most cabinets. The components used to mount the trays 36*a*, 36*b* can be installed in new cabinets or easily retrofitted into older cabinets, and can be employed with cabinets of different widths and front styles. Finally, the height of the trays within the cabinet can easily be adjusted without the need for tools.

Those skilled in this art will also recognize that the mounting members, dowels and the like can be used in other environments. For example, they may be included in shelves or display racks.

Figure 22:
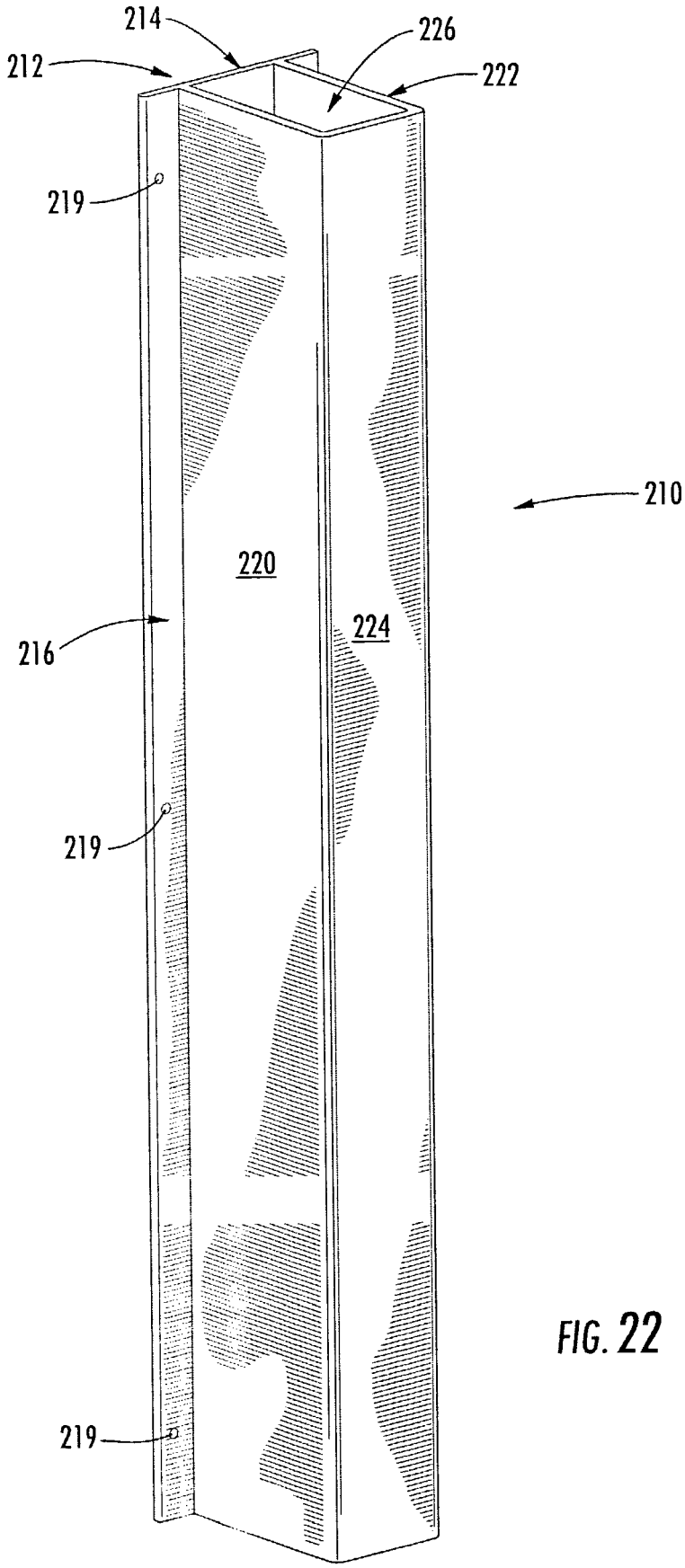
FIG. 22 is front perspective view of a cabinet an alternative connector of the present invention.
Figure 23:
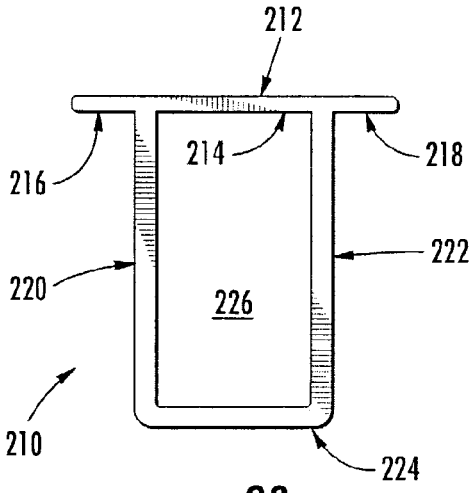
FIG. 23 is a top section view of the connector of FIG. 22.
Figure 24:
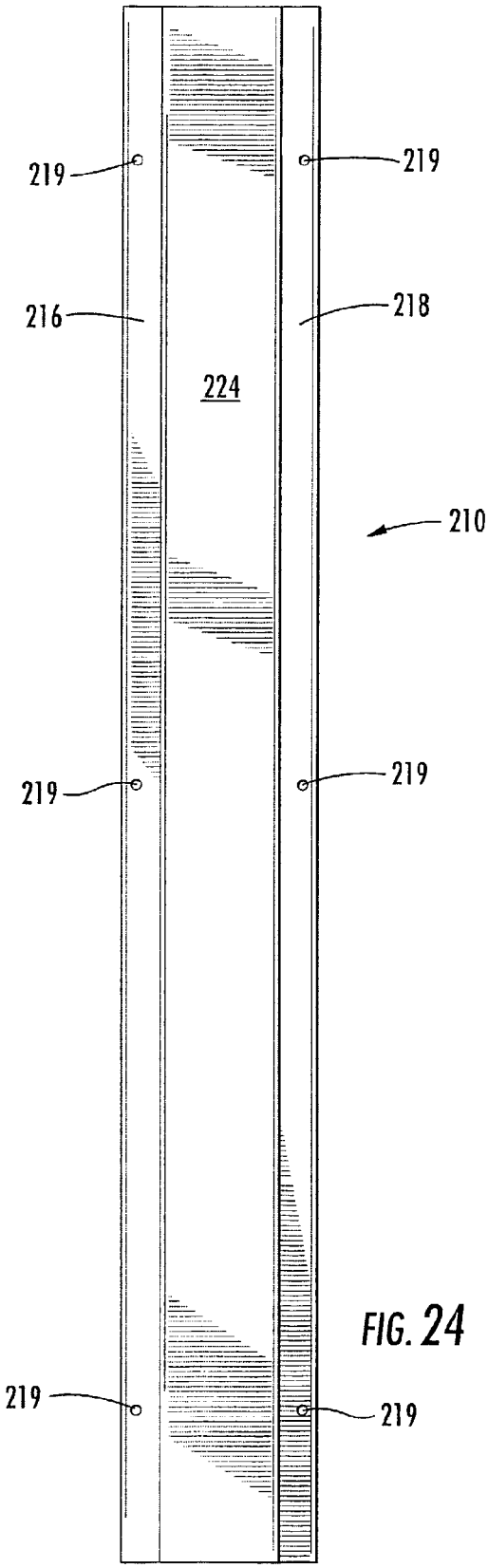
FIG. 24 is a front view of the connector of FIG. 22.

FIGS. 22-28 illustrate several additional connectors that may be used in embodiments of the present invention. FIGS. 22-24 depicts a connector 210 that may be used in lieu of either or both the front connectors 90 and the rear connectors 94 depicted in FIGS. 9 and 10. As shown in FIGS. 22-24, the connector 210 comprises a base 212, a first mounting panel 220 and a second mounting panel 222. The base 212 and the first and second mounting panels 220, 222 are each vertically elongated in that their length is substantially greater than their width. The first mounting panel 220 is spaced apart from and substantially parallel to the second mounting panel 222. Each of the first and second mounting panels 220, 222 project outwardly from the base 212. The distal ends of the first and second mounting panels 220, 222 may be connected by an end panel 224 that may reinforce the first and second mounting panels. The base 212, the first and second mounting panels 220, 222 and the end panel 224 define a channel 226 that runs along the longitudinal axis of the connector 210.

The base 212 comprises a base panel 214 and first and second lips 216, 218. The base panel 214 connects the first mounting panel 220 to the second mounting panel 222. The lips may include a plurality of apertures 219. Screws, staples, nails or other appropriate fasteners (screws typically being preferred) may be inserted through the apertures 219 or the lips 216, 218 to attach the connector 210 to the interior face of one of the walls that forms the cabinet 20. Preferably, the exterior face (i.e., the face opposite the channel 226) of the base 212 is configured to abut an interior face of one of the walls forming the cabinet 20. This may be accomplished, for example, by providing an exterior face that is planar or that is shaped to conform to the interior face of the wall of the cabinet 20 to which the connector 210 is to be attached.

Figure 25:
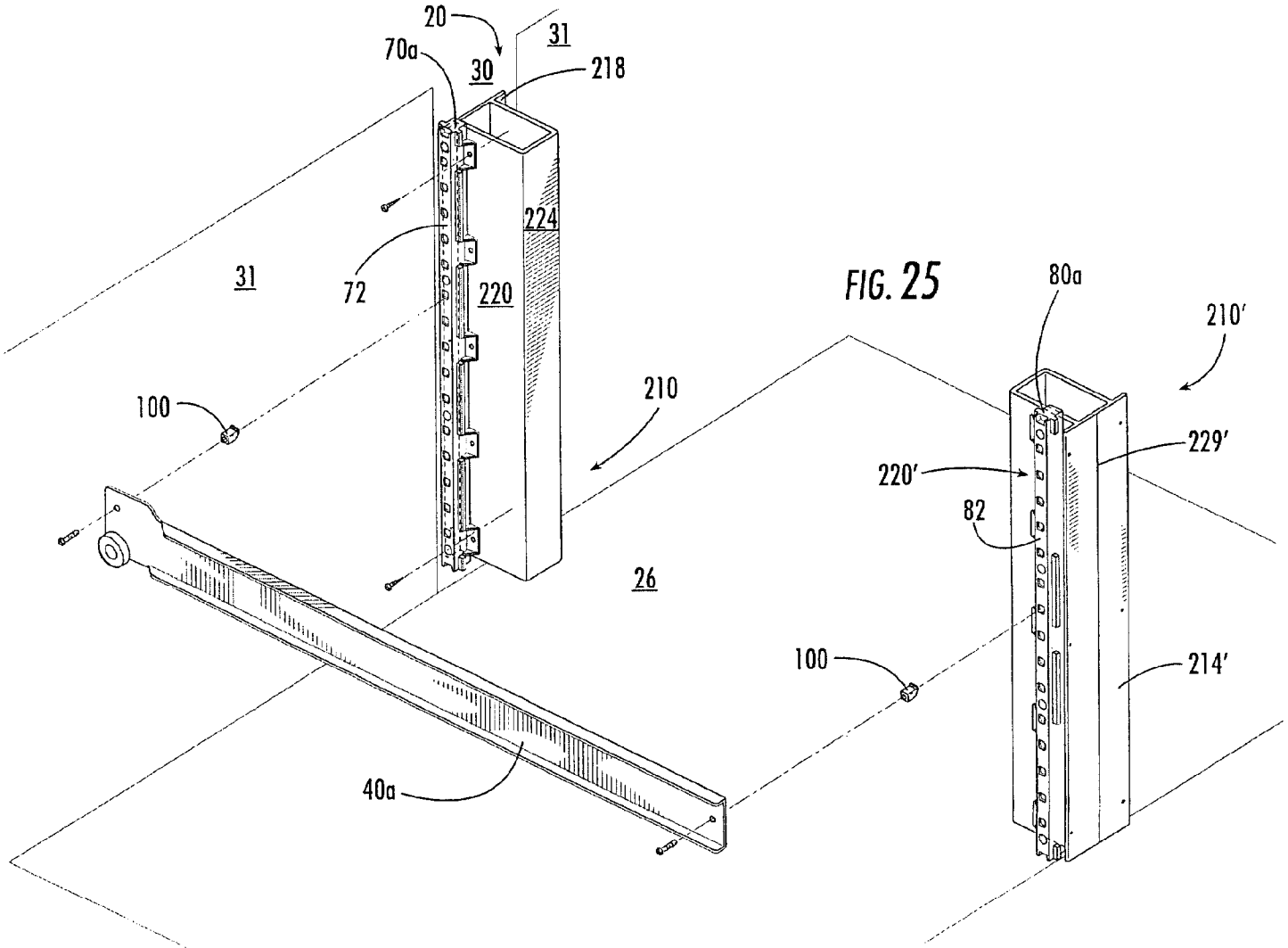
FIG. 25 is a rear exploded perspective view showing the mounting of an inner slide member into two inner mounting members using the connectors of FIG. 22 in the cabinet of FIG. 1.

FIG. 25 illustrates how the connector 210 may be used to facilitate mounting one or more drawers in the cabinet 20. It will be appreciated by those of skill in the art that the connector 210 may be particularly useful in mounting drawers within a cabinet (such as the cabinet 20 that is partially depicted in FIG. 25) that includes a front wall that has a central member 30 that defines two access openings 31 into the cabinet 20 (the access openings 31 being provided on either side of the central member 30). In FIG. 25, two connectors are shown: a connector 210 that is attached to the interior face of the central member 30 and a connector 210' that is attached to a central portion of the rear wall of the cabinet (the rear wall and side walls of the cabinet are not shown in FIG. 25). The connectors 210, 210' may be positioned so that their bottommost edges rests on the floor 26 of the cabinet 20.

A front inner mounting member 70*a* is attached to the exterior face of the first mounting panel 220. In FIG. 25, the front inner mounting member 70*a* is attached using screws, although various other fastening means could be used. The bottom end of mounting member 70*a* may be situated such that it rests on the floor 26 of the cabinet 20. A rear inner mounting member 80*a* is likewise attached to the exterior face of the first mounting panel 220' of the connector 210' that is attached to the rear wall of the cabinet 20. An inner slide member 40*a* is mounted on the front inner mounting member 70*a* and the rear inner mounting member 80*a*. In FIG. 25, the inner slide member 40*a* is attached to the mounting members 70*a*, 80*a* using mounting dowels 100 that are held in place by screws. It will be appreciated, however, that various other methods of mounting the inner slide member 40*a* to the mounting members 70*a*, 80*a* may be used.

While FIG. 25 only depicts mounting members 70*a* and 80*a*, it will be appreciated that a corresponding pair of front and rear outer mounting members would also be provided, along with an outer slide member adjacent the side wall of the cabinet 20. A tray may then be slidably mounted on the slide members. It will also be appreciated that trays and/or drawers may be provided within each access opening 31 of the cabinet 20 as illustrated in FIG. 1, and that more than one tray/drawer may be provided within either or both access openings 31.

The connector 210 may be very fast and easy to install. One problem with various prior art connectors is that the connectors typically have to be aligned very precisely in terms of both their horizontal and vertical placement to ensure that the drawers fit properly so that they will slide out of the access openings 31 and to ensure that the drawers are level. The connector 210 may be quickly aligned in the vertical direction by installing the connector 210 so that it rests on the floor 26 of the cabinet 20 (or alternatively, at a selected distance above the floor 26 of the cabinet 20), as the floor 26 typically will be level. The mounting member 70*a* may likewise be easily and precisely aligned in the vertical direction by attaching it to the connector 210 so that the mounting member 70*a* likewise rests on the floor 26 of the cabinet 20 or so that the bottom of the mounting member 70*a* is mounted at a selected distance above the floor 26. The connector 210' and the rear inner mounting member 80*a* may likewise by aligned in the vertical direction with reference to the floor 26 of the cabinet 20, as may the front and rear outer mounting members (which are not shown in FIG. 25). Thus, through use of the connectors 210, 210' of the present invention, an installer may quickly and easily obtain a uniform vertical alignment for all four mounting members and ensure that the drawer or tray of the cabinet is level when it is installed.

As shown best in FIG. 25, the connectors 210, 210' may also include an alignment slot 229, 229' that extends, for example, down the center of the exterior face of the base panel 214, 214'. An installer may align the alignment slots 229, 229' with the center of the central member 30 (or the center of the rear panel when connectors 210, 210' are installed) to quickly and easily ensure proper horizontal alignment of the connectors 210, 210'.

Figure 26:
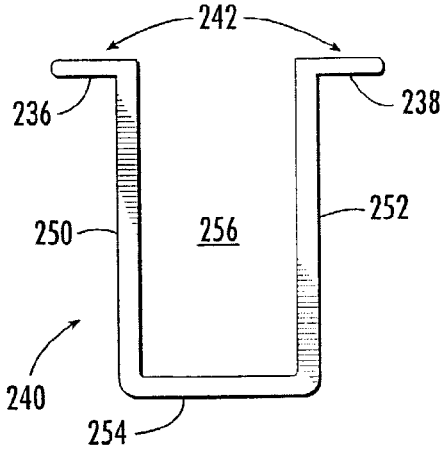
FIG. 26 is a top section view of another connector of the present invention.
Figure 26A:
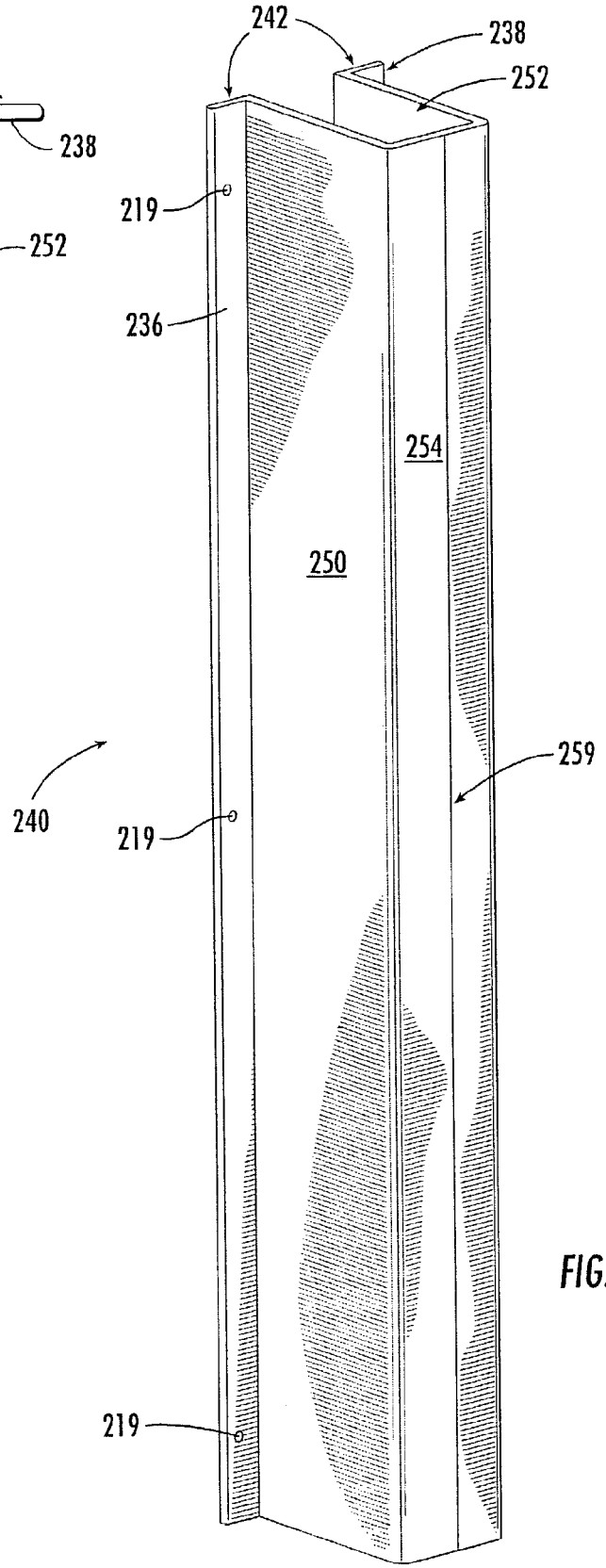
FIG. 26A is front perspective view of the connector of FIG. 26.

FIGS. 26 and 26A depict a connector 240 according to another embodiment of the present invention. As illustrated in FIGS. 26 and 26A, the connector 240 comprises a base 242, a first mounting panel 250 and a second mounting panel 252. The base 242 and the first and second mounting panels 250, 252 are each vertically elongated in that their length is substantially greater than their width. The first mounting panel 250 is spaced apart from and substantially parallel to the second mounting panel 252. Each of the first and second mounting panels 250, 252 project outwardly from the base 242. The distal ends of the first and second mounting panels 250, 252 may be connected by an end panel 254 that may reinforce the first and second mounting panels. The first and second mounting panels 250, 252 and the end panel 254 define a channel 256 that runs along the longitudinal axis of the connector 240.

In the embodiment of FIGS. 26 and 26A, the base 242 is a two section base (although the connector 240 typically would be a unitary structure) that comprises a first lip 236 and a second lip 238. Thus, the connector 240 differs from the connector 210 in that the base panel 214 of connector 210 is not present in the connector 240. While the base panel 214 serves to reinforce the connector 210 and make it more durable and rigid, it may not be needed to the extent that the connector is firmly attached to the wall of the cabinet on which the connector is mounted, as the wall of the cabinet may serve a similar reinforcing function. Obviously elimination of the base panel 214 advantageously reduces the amount of raw material required to form the connector 240. The lips 236, 238 may include a plurality of apertures 219 that facilitate attaching the connector 240 to the interior face of one of the walls that forms the cabinet. The connector 240 may also include an alignment slot 259 that extends, for example, down the center of the exterior face of the end panel 254. An installer may align this alignment slot 229 with the center of the central member 30 to quickly and easily ensure proper horizontal alignment of the connector 240. The connector 240 may be used in a manner similar to the connectors 90, 94, 210 and 210' described above.

Figure 27:
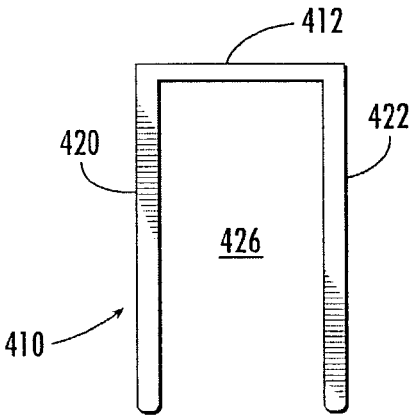
FIG. 27 is a top section view of another connector of the present invention.
Figure 27A:
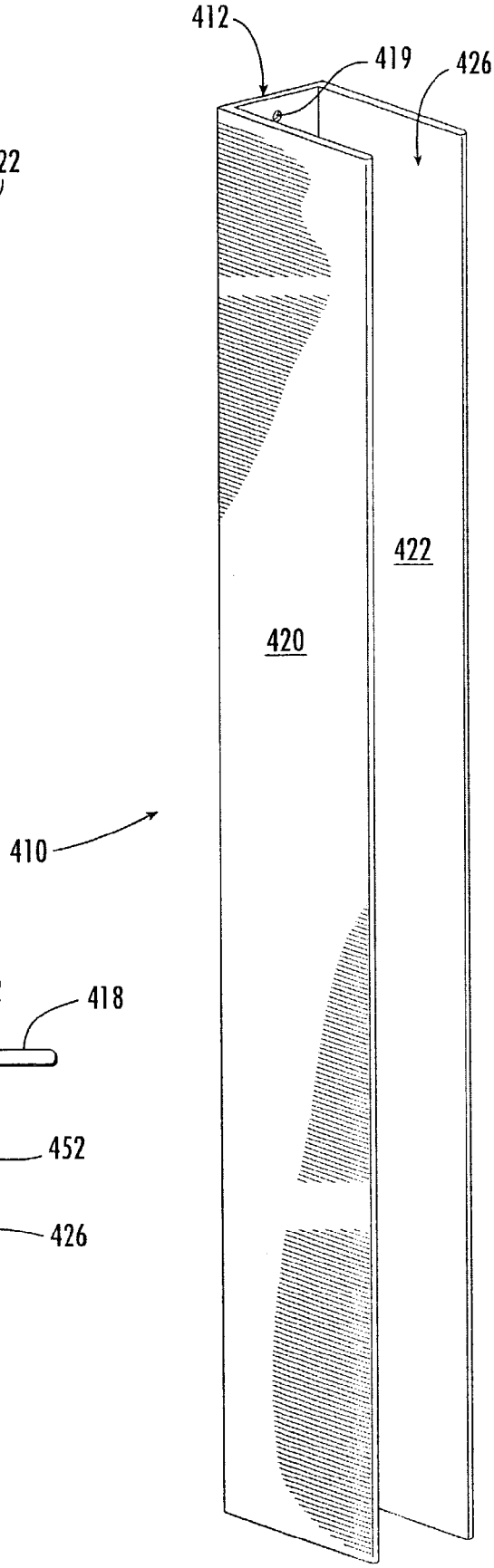
FIG. 27A is front perspective view of the connector of FIG. 27.

FIGS. 27 and 27A depict a connector 410 according to another embodiment of the present invention. As illustrated in FIGS. 27 and 27A, the connector 410 comprises a base 412, a first mounting panel 420 and a second mounting panel 422. The base 412 comprises a base panel 414. The base panel 414 and the first and second mounting panels 420, 422 are each vertically elongated in that their length is substantially greater than their width. The first mounting panel 420 is spaced apart from and substantially parallel to the second mounting panel 422. Each of the first and second mounting panels 420, 422 project outwardly from the base panel 412. The base panel 414 and the first and second mounting panels 420, 422 define a channel 426 that runs along the longitudinal axis of the connector 410.

The base panel 414 may include a plurality of apertures 419 that may facilitate fastening the connector 410 to the wall of a cabinet using screws, nails, or other fasteners known to those of skill in the art. Advantageously, the connector 410 includes less panels than various of the other connectors described herein and thus may be constructed using less raw material. The connector 410 may be used in a manner similar to the other connectors described above.

Figure 28:
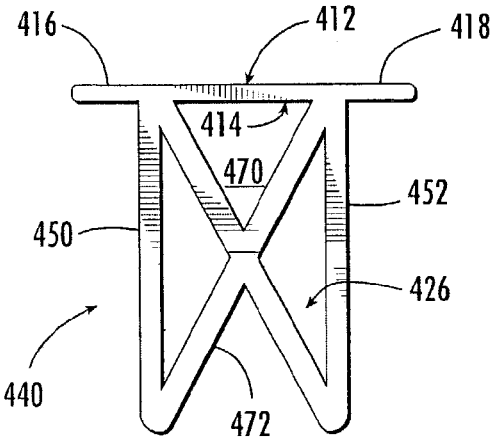
FIG. 28 is a top section view of another connector of the present invention.

Pursuant to another aspect of the present invention, connectors may be provided that include reinforcing members in the central channel that is provided in various of the connectors of the present invention. FIG. 28 depicts one such embodiment of the connectors of the present invention. As shown in FIG. 28, the connector 440 is identical to the connector 210, except that the end panel 224 of connector 210 is replaced by a pair of reinforcing members 470, 472 that form an X-shaped pair of walls in the center of the channel 426 that runs along the longitudinal axis of the connector. The X-shaped pair of walls 470, 472 may serve to reinforce the first and second mounting panels 450, 452. It will be understood that a wide variety of other reinforcing structures could be provided within the channel or external to the channel to reinforce the mounting panels or other aspects of the connectors of the present invention.

The connectors according to embodiments of the present invention may be formed of polymeric, typically thermoplastic, material such as polystyrene, polyethylene, polypropylene, nylon, high impact polystyrene, ABS and the like. The connectors may be manufactured by injection molding in accordance with conventional techniques, so that the resulting part is a single integral unit of thermoplastic material. Likewise, many of the connectors of the present invention may be formed using conventional extrusion techniques that are well known to those of skill in the art. When these techniques are used, the connector may comprise an extruded polymeric material. Furthermore, when extrusion techniques are used the connector may have a substantially constant cross section (apertures or the like may be drilled out such that the cross-section is not exactly constant). If extrusion techniques are used to form the connectors, it may be possible to ship long (e.g., six foot) segments of the connector that workman on-site may then cut to the desired size.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. As such, all such modifications are intended to be included within the scope of this invention. The scope of the invention is to be defined by the following claims.

That which is claimed is:

1. A connector that may be used in mounting one or more drawers within a cabinet, comprising:

a vertically elongated base configured to abut an interior face of a wall of the cabinet;

a vertically elongated first mounting panel connected to and projecting outwardly from the base;

a vertically elongated second mounting panel connected to and projecting outwardly from the base, wherein the second mounting panel is spaced apart from and substantially parallel to the first mounting panel; and wherein the connector is configured to simultaneously support both a first vertically elongated mounting member on the first mounting panel and a second vertically elongated mounting member on the second mounting panel.

2. A connector according to claim 1, wherein the base comprises a vertically elongated base panel extending perpendicular to and connecting the first mounting panel and the second mounting panel.

3. A connector according to claim 2, wherein the base further comprises a vertically elongated first lip extending outwardly from the base panel adjacent the connection between the base panel and the first mounting panel.

4. A connector according to claim 3, wherein the base further comprises a vertically elongated second lip extending outwardly from the base panel adjacent the connection between the base panel and the second mounting panel.

5. A connector according to claim 3, wherein the first lip includes a plurality of apertures for mounting the connector to the wall of the cabinet.

6. A connector according to claim 2, further comprising an end panel that connects the distal end of the first mounting panel and the distal end of the second mounting panel.

7. A connector according to claim 6, wherein the end panel is spaced apart from and substantially parallel to the base panel, and wherein the first mounting panel, the second mounting panel, the base panel and the end panel define a cavity that is generally rectangular in shape.

8. A connector according to claim 2, wherein the base panel includes an alignment slot running vertically down the center of the base panel.

9. A connector according to claim 1, wherein the base comprises a first lip connected to and extending perpendicularly from the outside face of the first mounting panel and a second lip connected to and extending perpendicularly from the outside face of the second mounting panel.

10. A connector according to claim 1, further comprising at least one reinforcing rib extending between the first mounting panel and the second mounting panel.

11. A connector according to claim 1, wherein the connector is a unitary structure formed of a polymeric material.

12. A connector according to claim 11, wherein the connector is an extruded polymeric material.

13. A connector according to claim 1, in combination with the first vertically elongated mounting member and the second vertically elongated mounting member, wherein each of the first and second vertically elongated mounting members are configured to support at least two drawer slides.

14. A connector that may be used in mounting a plurality of drawers within a cabinet, the connector comprising:

an elongate body portion having a base panel and first and second opposed, substantially parallel mounting panels projecting outwardly from the base panel so as to define a channel, wherein the body portion is configured to simultaneously support at least first and second mounting members;

a first lip extending from a first lateral edge of the base panel and perpendicular to the first and second mounting panels, the first lip including a plurality of apertures; and a second lip extending from a second lateral edge of the base panel and perpendicular to the first and second mounting panels, the second lip including a plurality of apertures.

15. A connector according to claim 14, further comprising an end panel that connects the distal ends of the first and second mounting panels.

16. A connector according to claim 15, wherein the connector is a unitary structure formed of a polymeric material.

17. A connector according to claim 16, wherein the connector is an extruded polymeric material.

18. A connector according to claim 14, further comprising an alignment slot running vertically down the center of the base panel.

19. A connector according to claim 14, wherein the drawer comprises a tray drawer.

20. A cabinet adapted to receive a drawer, the cabinet comprising:

an enclosure comprising an upright rear wall, opposing upright side walls fixed at rear portions thereof to opposite ends of the rear wall, an upright front wall opposing the rear wall and fixed to respective front portions of the side walls, the upright front wall including an access opening and a central member that extends generally vertically across the access opening;

a connector comprising a vertically elongated base configured to abut an interior face of the central member, a vertically elongated first mounting panel connected to and projecting outwardly from the base, and a vertically elongated second mounting panel connected to and projecting outwardly from the base, wherein the second mounting panel is spaced apart from and substantially parallel to the first mounting panel;

a pair of front outer mounting members mounted generally upright adjacent front portions of the side walls;

a pair of rear outer mounting members mounted generally upright adjacent rear portions of the side walls;

a pair of front inner mounting members mounted generally upright on the respective first and second mounting panels of the connector, each of the front inner mounting members facing one of the pair of the front outer mounting members;

a pair of rear inner mounting members mounted generally upright adjacent a central portion of the rear wall, each of the rear inner mounting members facing one of the pair of the rear outer mounting members;

a pair of outer slide members, each outer slide member extending between a respective rear outer mounting member and a respective front outer mounting member; and a pair of inner slide members, each inner slide member extending between a respective rear inner mounting member and a respective front inner mounting member.

21. The cabinet of claim 20, further comprising four pairs of mounting dowels, with one mounting dowel of each pair connecting a rear end portion of one of the slide members to a respective rear mounting member, and with the other mounting dowel of each pair connecting a front end portion of one of the slide members to a respective front mounting member.

22. The cabinet of claim 21, wherein each of the mounting members have a mounting surface with a plurality of mounting apertures.

23. The cabinet of claim 22, wherein each of the mounting dowels is sized and configured to be received in one of the plurality of apertures in one of the respective mounting members, and wherein each slide member is generally horizontally disposed and each slide member of the pair of slide members is mounted at approximately the same height as the other slide member of the pair.

24. The cabinet of claim 23, wherein each of the mounting apertures are non-circular and wherein each of the mounting dowels has a body that is non-circular in cross-section.

25. The cabinet of claim 20, further comprising a tray slidably mounted on one of the pair of inner slide members and on one of the pair of outer slide members.

26. The cabinet of claim 20, further comprising a second connector comprising a vertically elongated base configured to abut the interior face of a central portion of the rear wall, a vertically elongated first mounting panel connected to and projecting outwardly from the base, and a vertically elongated second mounting panel connected to and projecting outwardly from the base, wherein the second mounting panel is spaced apart from and substantially parallel to the first mounting panel; and wherein the pair of rear inner mounting members are mounted on the respective first and second mounting panels of the second connector.

27. The cabinet according to claim 20, wherein the base of the connector further comprises a vertically elongated first lip extending outward from the base adjacent the connection between the base and the first mounting panel.

28. The cabinet according to claim 27, wherein the base of the connector further comprises a vertically elongated second lip extending outward from the base adjacent the connection between the base and the second mounting panel.

29. The cabinet of claim 27, wherein the first lip includes a plurality of apertures for mounting the connector to the wall of the cabinet.

30. The cabinet of claim 27, further comprising an end panel that connects the distal end of the first mounting panel and the distal end of the second mounting panel.

31. The cabinet of claim 20, wherein the base comprises a first lip connected to and extending perpendicularly from the outside face of the first mounting panel and a second lip connected to and extending perpendicularly from the outside face of the second mounting panel.

32. The cabinet of claim 20, wherein the connector is a unitary structure formed of a polymeric material.

33. The cabinet of to claim 20, wherein the connector is an extruded polymeric material.

34. An assembly for mounting a drawer within a cabinet, comprising:

an elongate slide member adapted for mounting within the cabinet and for slidably mating with an engagement member of a sliding tray;

a pair of mounting members; and a connector comprising a vertically elongated base, a vertically elongated first mounting panel connected to and projecting outwardly from the base, and a vertically elongated second mounting panel connected to and projecting outwardly from the base, wherein the second mounting panel is spaced apart from and substantially parallel to the first mounting panel;

wherein the base comprises a vertically elongated base panel extending perpendicular to both the first mounting panel and to the second mounting panel that connects the first mounting panel and the second mounting panel;

wherein the base further comprises a vertically elongated first lip extending outwardly from the base panel adjacent the connection between the base panel and the first mounting panel, wherein the first lip includes at least one aperture for mounting the connector to the wall of the cabinet;

wherein the base panel includes an alignment slot running vertically down the center of the base panel.

35. A method of installing a drawer in proper alignment within a face-frame cabinet having a front wall that defines at least one access opening into the cabinet comprising:

attaching a connector to the wall of the cabinet so that the bottom surface of the connector contacts the floor of the cabinet;

attaching a mounting member to the connector such that the bottom of the mounting member is positioned at a predetermined height above the floor the cabinet;

attaching a first slide member to the mounting member;

mounting a second slide member within the cabinet; and slidably installing the drawer on the first and second slide members.

36. The method of claim 35, wherein the predetermined height is zero inches.

37. The method of claim 35, wherein the connector comprises a vertically elongated base, a vertically elongated first mounting panel connected to and projecting outwardly from the base, and a vertically elongated second mounting panel connected to and projecting outwardly from the base, wherein the second mounting panel is spaced apart from and substantially parallel to the first mounting panel.

38. The method of claim 37, wherein the base comprises a vertically elongated base panel extending perpendicular to both the first mounting panel and to the second mounting panel that connects the first mounting panel and the second mounting panel.

39. The method of claim 38, wherein the base further comprises a vertically elongated first lip extending outwardly from the base panel adjacent the connection between the base panel and the first mounting panel, wherein the first lip includes at least one aperture for mounting the connector to the wall of the cabinet.

* * * * *